US007701472B2

(12) United States Patent
Obinata

(10) Patent No.: US 7,701,472 B2
(45) Date of Patent: Apr. 20, 2010

(54) DISPLAY CONTROLLER, ELECTRONIC DEVICE, AND METHOD OF SUPPLYING IMAGE DATA

(75) Inventor: Atsushi Obinata, Tokyo (JP)

(73) Assignee: Seiko Epson Corporation (JP)

( * ) Notice: Subject to any disclaimer, the term of this patent is extended or adjusted under 35 U.S.C. 154(b) by 1002 days.

(21) Appl. No.: 11/141,309

(22) Filed: May 31, 2005

(65) Prior Publication Data

US 2005/0270308 A1 Dec. 8, 2005

(30) Foreign Application Priority Data

Jun. 8, 2004 (JP) ..... 2004-169901

(51) Int. Cl.
*G09G 5/00* (2006.01)

(52) U.S. Cl. ..... 345/649; 345/667; 345/670; 345/656

(58) Field of Classification Search ..... 345/555, 345/649, 667, 660, 656, 670
See application file for complete search history.

(56) References Cited

U.S. PATENT DOCUMENTS

| | | | | |
|---|---|---|---|---|
| 5,973,664 | A * | 10/1999 | Badger | 345/659 |
| 6,031,546 | A * | 2/2000 | Shimizu | 345/656 |
| 6,897,882 | B1 * | 5/2005 | Kim | 345/659 |
| 6,999,105 | B2 * | 2/2006 | Buerkle et al. | 345/660 |
| 7,162,104 | B2 * | 1/2007 | Westphal et al. | 382/305 |
| 7,194,149 | B2 * | 3/2007 | Westphal et al. | 382/305 |
| 7,346,376 | B2 * | 3/2008 | Hamamura et al. | 455/575.3 |
| 2004/0252139 | A1 * | 12/2004 | Takizawa et al. | 345/649 |
| 2006/0133693 | A1 * | 6/2006 | Hunt | 382/293 |

FOREIGN PATENT DOCUMENTS

| | | |
|---|---|---|
| JP | 10/210349 | 8/1998 |
| JP | 2001-203925 | 7/2001 |
| JP | 2001-285685 | 10/2001 |
| JP | 2003-219239 | 7/2003 |

* cited by examiner

*Primary Examiner*—M Good Johnson
(74) *Attorney, Agent, or Firm*—Harness, Dickey & Pierce, P.L.C.

(57) ABSTRACT

A display controller comprising: an image data input interface; a first image processing section for a first processing operation including at least a turning operation to turn an orientation of an image of the image data with a first turning angle or a mirror image reversing operation; a second image processing section for a second processing operation including at least a turning operation to turn an orientation of an image of the image data with a second turning angle or a mirror image reversing operation; an image data compressing section compressing the image data after the first processing operation; a memory for the compressed data where the image data, after the compressing operation, are stored; a host interface to/from which the imaged data stored in the memory are input and output; and a display driver interface outputting the image data, after the second processing operation, to the display driver.

9 Claims, 21 Drawing Sheets

TURNING ANGLE = 0 DEGREES & MIRROR FUNCTION = OFF

TURNING ANGLE = 90 DEGREES & MIRROR FUNCTION = ON

TURNING ANGLE = 90 DEGREES & MIRROR FUNCTION = OFF

TURNING ANGLE = 0 DEGREES & MIRROR FUNCTION = ON

TURNING ANGLE = 270 DEGREES & MIRROR FUNCTION = OFF

TURNING ANGLE = 180 DEGREES & MIRROR FUNCTION = ON

TURNING ANGLE = 180 DEGREES & MIRROR FUNCTION = OFF

TURNING ANGLE = 270 DEGREES & MIRROR FUNCTION = ON

DISPLAY CONTROLLER, ELECTRONIC DEVICE, AND METHOD OF SUPPLYING IMAGE DATA

RELATED APPLICATIONS

This application claims priority to Japanese Patent Application No. 2004-169901 filed Jun. 8, 2004 which is hereby expressly incorporated by reference herein in its entirety.

BACKGROUND

1. Technical Field

The present invention relates to a display controller, an electronic device, and a method of supplying image data.

2. Related Art

In recent years display panels such as a liquid crystal display (LCD) panel, as a representing one for example, are widely mounted on portable devices such as cellular phones and so on (electronic devices, in a wide sense). Such a display panel is driven by a display driver according to image data; which are sometimes those captured by a camera module for example, or what a host has created or processed. While receiving such image data as well as a display synch signal, the display driver carries out driving control of the display panel. Substituting for the host, a display controller performs supply of the image data and synch signal to make it possible to lighten an operation load of the host.

For the purpose of displaying an image, for example, captured through a camera module onto a display panel; a display controller outputs image data coming from the camera module to a display driver. Meanwhile, in order to store the image data of a still image or a motion picture captured through the camera module, it is possible to carry out a compressing operation for the image data.

By the way, the orientation of such an image captured through a camera module is mostly fixed. Therefore, the display controller conventionally turns the orientation of the image of the image data coming from the camera module to create the turned image data and supply the turned image data to the display driver, and/or compresses the image data for the purpose of storing the image data of still images and so on.

However, the orientation of the image to be displayed on the display panel and that of the image to be compressed are sometimes different each other. In such a case, it is impossible to turn the orientation of the image with different turn angles at the same time, and therefore conventionally, the turning operation for each frame is carried out separately for the purpose of displaying and compressing operations with each different turning angle. As a result, the frame of the image to be displayed on the display panel is different from the frame of the compressed image to be stored, and it causes a problem that images captured by continuous shootings of the camera module and/or data saved as a motion picture become different from those displayed on the display panel.

The present invention has been materialized, while paying attention to the technical problem described above; and the purpose of the present invention is to provide a display driver, an electronic device, and a method of supplying image data that enable displaying a display image, the frame of which is the same as that of the image for compressing operation, even under a condition where the orientation of the image for compressing operation is different from the orientation of the display image.

SUMMARY

To provide the above problem with a solution, the present invention relates to a display controller, which is connected to a host and supplies image data to a display driver for driving a display panel, comprising: an image data input interface to which the image data are input; a first image processing section for a first processing operation that includes at least either of a turning operation to turn an orientation of an image of the image data with a first turning angle and a mirror image reversing operation; a second image processing section for a second processing operation that includes at least either of a turning operation to turn an orientation of an image of the image data with a second turning angle and a mirror image reversing operation; an image data compressing section that compresses the image data after the first processing operation; a memory for the compressed data where the image data, after the compressing operation, are stored; a host interface to/from which the imaged data stored in the memory for the compressed data are input and output; and a display driver interface that outputs the image data, after the second processing operation, to the display driver, wherein the first image processing section and the second image processing section carry out the first processing operation and the second processing operation on image data of an identical frame input through the image data input interface.

In the present invention; the first image processing section can carry out the first processing operation on image data that is, for example, served to a compressing operation for the purpose of storage, and meanwhile the second image processing section is able to carry out the second processing operation on image data that is, for example, served to the display driver for the purpose of a displaying operation. On this occasion, the first image processing section and the second image processing section can individually carry out their own turning operation and mirror image reversing operation. Accordingly, for image data of an identical frame; the image data after the first processing operation is stored in the memory for the compressed data, while the image data after the second processing operation is output to the display driver interface.

Consequently, even under a condition where the orientation of the image to be displayed on the display panel is different from the orientation of the image being objective for compressing operation; the frame of the display image on the display panel and the frame of the compressed image can have an image of the same frame. Therefore, it becomes possible to avoid any such circumstances where the image for displaying and the image to be actually stored are different from each other.

Furthermore, the display controller relating to the present invention comprises: a first image size reducing section and a second image size reducing section to create image data reduced in size with a first reduction ratio and a second reduction ratio, respectively, from the image data input through the image data input interface, wherein the first image processing section carries out the first processing operation for the image data created by the first image size reducing section, and the second image processing section carries out the second processing operation for the image data created by the second image size reducing section, and the first image size reducing section and the second image size reducing section can create the image data reduced in size with the first reduction ratio and the second reduction ratio, respectively, for the image size of identical image data.

The image data input through the image data input interface are captured, for example, by a camera module. Improvement of such a camera module to provide the camera module itself with higher functions is under way still further, and size of an image captured by the camera module tends to become greater. On the other hand; for example, size of a compressed image to be used for storing and size of an image to be displayed on a display panel can be small enough in most cases. Therefore, since the processing operations described above are carried out after the image size reduction according to the present invention, the processing operations complete in a short time so that it becomes possible to reduce power consumption.

Furthermore, the display controller relating to the present invention comprises: a compression image memory where the image data created by the first image size reducing section are stored, and a display image memory where the image data created by the second image size reducing section are stored, wherein the first image processing section can read the image data out of the compression image memory and carry out the first processing operation for the image data, and the second image processing section can read the image data out of the display image memory and carry out the second processing operation for the image data.

In the present invention, placing the compression image memory between the first image size reducing section and the first image processing section makes it possible to avoid such inconvenience that a processing operation for the image data input continuously through the image data input interface cannot be done in time. Being compared with a case where the image size of the image data input through the image data input interface is reduced at first, and a turning operation and so on is subsequently carried out, and then a compressing operation is done; the case of the present invention reduces the image size and once stores the data into the compression image memory. As a result, for any image data input at higher speed, it becomes possible to surely carry out the compressing operation. Furthermore, since the image size is reduced before storing, the capacity of the compression image memory can become smaller.

Similarly, placing the display image memory between the second image size reducing section and the second image processing section 60 makes it possible to avoid such inconvenience that a processing operation for the image data input continuously through the image data input interface cannot be done in time. Being compared with a case where the image size reduction is carried out at first for the image data input through the image data input interface, and a turning operation and so on is subsequently carried out, and then the image data are output to the display driver; the case of the present invention reduces the image size and once stores the data into the display image memory. As a result, for any image data input at higher speed, it becomes possible to surely output the image data to the display driver. Furthermore, since the image size is reduced before storing, the capacity of the display image memory can become smaller.

Furthermore, the display controller relating to the present invention comprises: a compression image memory where the image data after the first processing operation are stored, and a display image memory where the image data after the second processing operation are stored, wherein the image data compressing section can carry out the compressing operation for the image data read out of the compression image memory, and the display driver interface can supply the display driver with the image data read out of the display image memory.

Being compared with a case where the image size of the image data input through the image data input interface is reduced at first, and a turning operation and so on is subsequently carried out, and then a compressing operation is done; the case of the present invention reduces the image size and once stores the data into the compression image memory. As a result, for any image data input at higher speed, it becomes possible to surely carry out the compressing operation. Furthermore, since the image size is reduced before storing, the capacity of the compression image memory can become smaller.

Similarly, being compared with a case where the image size reduction is carried out at first, and a turning operation and so on is subsequently carried out, and then the image data are output to the display driver; the case of the present invention reduces the image size and once stores the data into the display image memory. As a result, for any image data input at higher speed, it becomes possible to surely output the image data to the display driver. Furthermore, since the image size is reduced before storing, the capacity of the display image memory can become smaller.

Furthermore, in the display controller relating to the present invention; the first image size reducing section and the second image size reducing section can create image data in such a manner that the size of the image reduced by the first image size reducing section becomes greater than the size of the image reduced by the second image size reducing section.

By application of the present invention, the image size of the image data for displaying can be made to be smaller than the image size of the image data to be compressed so that an optimum image size control can be done to meet a need of the image.

Furthermore, the present invention relates to an electronic device, comprising: a display panel; a display controller described by any of the above; and a display driver for driving the display panel according to image data supplied by the display controller.

Furthermore, the electronic device relating to the present invention can comprise a host that inputs and outputs image data to/from the display controller.

Even under a condition where the orientation of the image of the image data to be output to the display panel is different from the orientation of the image of the image data to be compressed, applying the present invention enables the display image and the compressed image to have an image of the same frame. Therefore, it becomes possible to avoid any such circumstances where the image for displaying and the image to be compressed are different from each other.

Furthermore, the present invention relates to a method of supplying image data to supply the image data to a display driver for driving a display panel, comprising: a first processing operation that includes at least either of a turning operation to turn an orientation of an image with a first turning angle and a mirror image reversing operation, for image data input from an image capturing section; a second processing operation that includes at least either of a turning operation to turn an orientation of an image with a second turning angle and a mirror image reversing operation, for the input image data; a compressing operation for the image data for which the first processing operation has been carried out; and a step of supplying the image data, for which the second processing operation has been carried out, to the display driver.

In the method of supplying image data, which relates to the present invention; the first processing operation can be carried out for image data created by reducing image size of the input image data with a first reduction ratio, and the second processing operation can be carried out for image data created by reducing image size of the input image data with a second reduction ratio.

In the method of supplying image data, which relates to the present invention; image data with size reduction can be created in such a manner that the size of the image reduced with the first reduction ratio becomes greater than the size of the image reduced with the second reduction ratio.

DETAILED DESCRIPTION

An embodiment of the present invention will be described in detail with reference to the accompanying drawings. Incidentally, the embodiment explained below does not unfairly confine the contents of the present invention described in the section of the claims. Furthermore, all the structures explained below are not necessarily the indispensable constituent features of the present invention.

Figure 1:
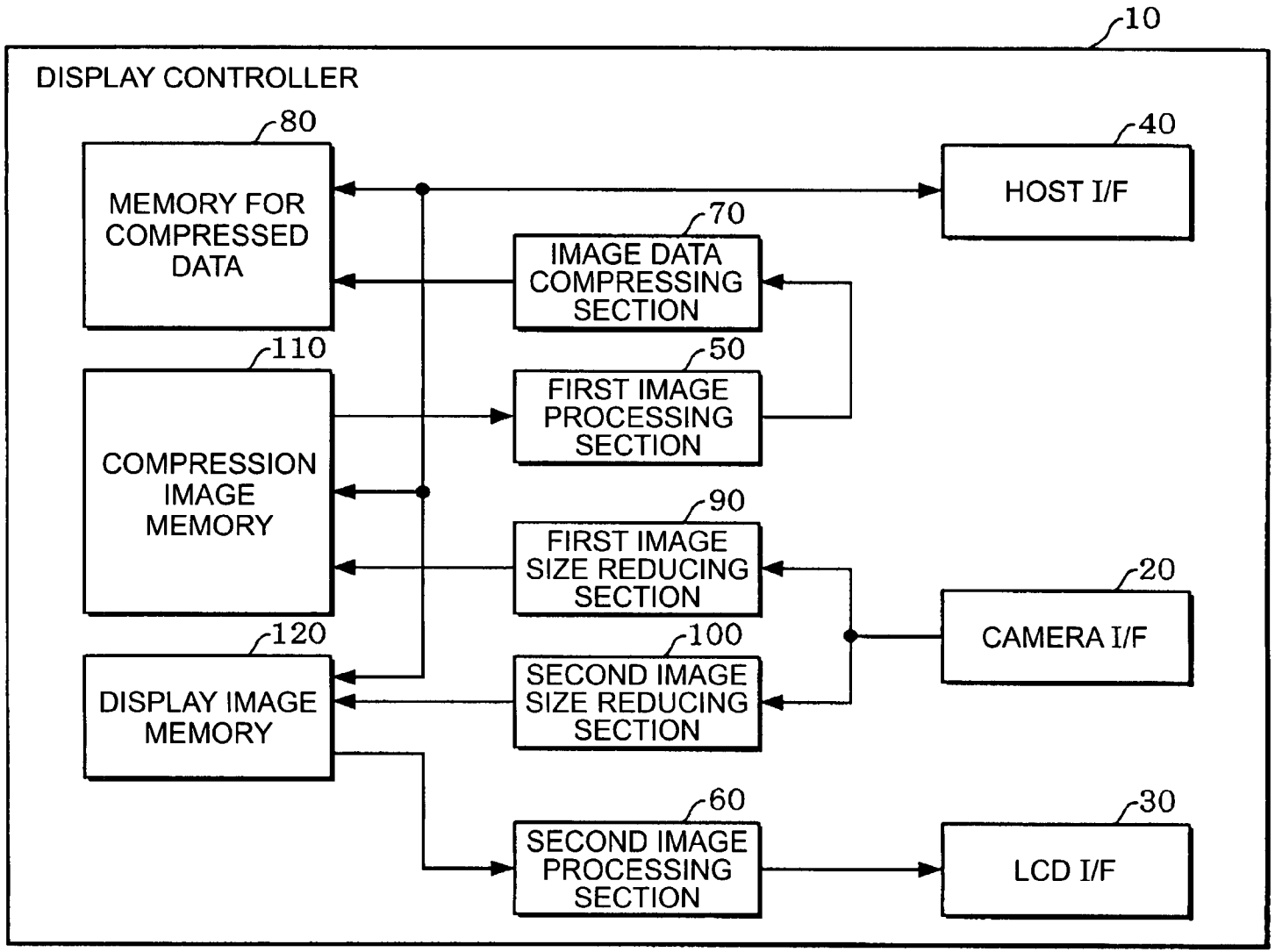
FIG. 1 shows a block diagram to illustrate a general structure of a display controller of the present embodiment.

FIG. 1 shows a block diagram of the structure of a display controller of this embodiment.

A display controller (LCD controller) 10 is placed between a host and a display driver that are not illustrated in the drawing. Then, the display controller 10 supplies the display driver (LCD driver), which drives a display panel (LCD panel), with image data.

The display controller 10 comprises: a camera interface (Interface: I/F) circuit (Image data input interface, in a wide sense) 20, an LCD I/F circuit (Display driver interface, in a wide sense) 30, and a host I/F circuit (Host interface, in a wide sense) 40.

Image data from a camera module as an image capturing section, which is not illustrated in the drawing, are input into the camera I/F circuit 20. The camera I/F circuit 20 carries out an interface operation for the image data (receiving the data from the camera module, and signal buffering). The LCD I/F circuit 30 outputs the image data to the display driver that is not illustrated in the drawing. The LCD I/F circuit 30 carries out an interface operation for the image data (transmitting the data to the display driver, and signal buffering), and outputs the image data after the interface processing to the display driver. Image data from the host; which creates and processes the image data, and is not illustrated in the drawing; are input into the host I/F circuit 40. At this time, the host I/F circuit 40 carries out an interface operation (receiving from the host, and signal buffering), and supplies the image data after the interface processing to a memory inside the display controller 10 to write the data into the memory. On the other hand, image data read out of a memory inside the display controller 10 are input to the host I/F circuit 40. The host I/F circuit 40 carries out an interface operation for the image data (transmitting to the host, and signal buffering), and outputs the image data after the interface processing to the host.

The display controller 10 comprises: a first image processing section 50, a second image processing section 60, an image data compressing section 70, and a memory for compressed data 80.

The first image processing section 50 carries out a first processing operation. The first processing operation includes at least either of a turning operation to turn an orientation of an image with a first turning angle and a mirror image reversing operation (mirror reversing), for the image data input into the first image processing section 50. When the first image processing section 50 carries out the turning operation; the orientation of the image is turned for the first turning angle that is set up in the first image processing section 50, to create image data after the turning operation, while using a specified datum point as a datum. When the first image processing section 50 carries out the mirror image reversing operation; on condition that the setting for the operation is enabled by enabling information, image data are created in such a manner that pixel arrangement order in the horizontal direction of the image after the processing operation is reversed to that of the image before the processing operation.

The second image processing section 60 carries out a second processing operation. The second processing operation includes at least either of a turning operation to turn an orientation of an image with a second turning angle and a mirror image reversing operation, for the image data input into the second image processing section 60. When the second image processing section 60 carries out the turning operation; the orientation of the image is turned for the second turning angle that is set up in the second image processing section 60, to create image data after the turning operation, while using a specified datum point as a datum. When the second image processing section 60 carries out the mirror image reversing operation; on condition that the setting for the operation is enabled by enabling information, image data are created in such a manner that pixel arrangement order in the horizontal direction of the image after the processing operation is reversed to that of the image before the processing operation.

The first image processing section 50 and the second image processing section 60 can be provided, for example, with the same structure; as far as they are able to create each distinctive image data by their own different turning operation or mirror image reversing operation, from the image data of an identical frame The image data compressing section 70 carries out a compressing operation on image data. As the compressing operation, an operation specified according to the standards of JPEG (Joint Photographic Experts Group) and/or MPEG (Moving Picture Experts Group) can be applied. The image data compressing section 70 carries out the compressing operation described above on the image data after the first processing operation done by the first image processing section 50. Then, the image data after the compressing operation carried out by the image data compressing section 70 are stored in the memory for compressed data 80. The image data stored in the memory for compressed data 80 are output to the host through the host I/F circuit 40. On the other hand, the image data processed by the host are stored into the memory for compressed data 80 through the host I/F circuit 40.

Meanwhile, the image data after the second processing operation done by the second image processing section 60 are supplied to the LCD I/F circuit 30.

Then, the first image processing section 50 and the second image processing section 60 carry out the first processing operation and the second processing operation, respectively, on the image data of the identical frame input through the camera I/F circuit 20. On this occasion, the first image processing section 50 and the second image processing section 60 are able to carry out their turning operation according to the first turning angle and the second turning angle, respectively, which are specified independently. Or, alternatively, the first image processing section 50 and the second image processing section 60 are able to carry out their mirror image reversing operation according to enabling information for the mirror image reversing operation of each image processing section, which are specified independently.

Thus, the first image processing section 50 carries out the first processing operation on the image data to be served to the compressing operation for storing. Meanwhile, the second image processing section 60 carries out the second processing operation on the image data to be served to the display driver for displaying. On this occasion, the first image processing section 50 and the second image processing section 60 are able to carry out their own specific turning operation and mirror image reversing operation individually. Consequently, with regard to the image data of the identical frame; the image data after the first processing operation are stored in the memory for compressed data 80 for storing, while the image data after the second processing operation are output to the LCD I/F circuit 30 for displaying.

Incidentally, the image data for storing are, for example, sometimes read out by the host so as to get stored into a storing memory that is attachable and removable to/from the portable device, or to be served to transmission by a communication means that is not illustrated in the drawing.

Based on the configuration described above, even under a condition where the orientation of the image to be displayed on the display panel is different from the orientation of the image being objective for compressing operation; the frame of the display image on the display panel and the frame of the compressed and stored image can be of the same frame. Thus, it becomes possible to avoid any such circumstances where the image for displaying and the image to be actually stored are different from each other.

Then, it is preferable that the display controller 10 can carry out the first and second processing operations after reducing the image size of the image data input through the camera I/F circuit 20. The image size of image data captured by a camera module, having a way of improving its functions nowadays, tends to become greater. However, the size of an image for storing and displaying can be small enough in most cases. Therefore, an image with its smaller size results in a shorter processing time in the processing operation described above so as to enable reducing the power consumption.

Thus, the display controller 10 can include a first image size reducing section 90 and a second image size reducing section 100. The first image size reducing section 90 creates image data, reduced in image size with the first reduction ratio, from the image data input through the camera I/F circuit 20. Meanwhile, the second image size reducing section 100 creates image data, reduced in image size with the second reduction ratio, from the image data input through the camera I/F circuit 20. The first image size reducing section 90 and the second image size reducing section 100 create the image data reduced in size with the first reduction ratio and the second reduction ratio that are individually specified, respectively, from the identical image data.

Then, the first image processing section 50 carries out the first processing operation for the image data created by the first image size reducing section 90. Meanwhile, the second image processing section 60 carries out the second processing operation for the image data created by the second image size reducing section 100.

The first reduction ratio and the second reduction ratio can be the same, or different from each other. When uses of the images are taken into consideration, the size of the image for displaying is smaller than that of the image for storing in most cases. On this occasion, it is preferable that the first image size reducing section 90 and the second image size reducing section 100 create the image data with their size reduction in such a manner that the size of the image reduced with the first reduction ratio becomes greater than that of the image reduced with the second reduction ratio. In other words; when a greater reduction ratio results in a smaller image size, it is preferable that the first reduction ratio is smaller than the second reduction ratio.

Furthermore, the display controller 10 can include a compression image memory 110 and a display image memory 120. The compression image memory 110 stores the image data created by the first image size reducing section 90, while the display image memory 120 stores the image data created by the second image size reducing section 100. Then, the first image processing section 50 reads the image data out of the compression image memory 110 and carries out the first processing operation, while the second image processing section 60 reads the image data out of the display image memory 120 and carries out the second processing operation.

As described above, by placing the compression image memory 110 between the first image size reducing section 90 and the first image processing section 50, it becomes possible to avoid such inconvenience that the processing operation for image data input continuously through the camera I/F circuit 20 cannot be carried out in time. Being compared with a case where the image size of the image data input through the camera I/F circuit 20 is reduced at first, and a turning operation and so on is subsequently carried out, and then a compressing operation is done; the case of this embodiment reduces the image size and once stores the data into the compression image memory 110. As a result, for any image data input at higher speed, it becomes possible to surely carry out the compressing operation. Furthermore, since the image size is reduced before storing, the capacity of the compression image memory 110 can become smaller.

In the same manner, by placing the display image memory 120 between the second image size reducing section 100 and the second image processing section 60, it becomes possible to avoid such inconvenience that the processing operation for image data input continuously through the camera I/F circuit 20 cannot be carried out in time. Being compared with a case where the image size reduction is carried out at first for the image data input through the camera I/F circuit 20, and a turning operation and so on is subsequently carried out, and then the image data are output to the display driver; the case of this embodiment reduces the image size and once stores the data into the display image memory 120. As a result, for any image data input at higher speed, it becomes possible to surely output the image data to the display driver. Furthermore, since the image size is reduced before storing, the capacity of the display image memory 120 can become smaller.

Incidentally, the display controller 10 includes the compression image memory 110 and the display image memory 120 in addition to the memory for compressed data 80. These memories can be installed as one memory block, or as multiple memory blocks, as far as it is possible to access any of the memories independently.

In the following sections, the present embodiment is described by contrast with a comparative example for the present embodiment.

Figure 2:
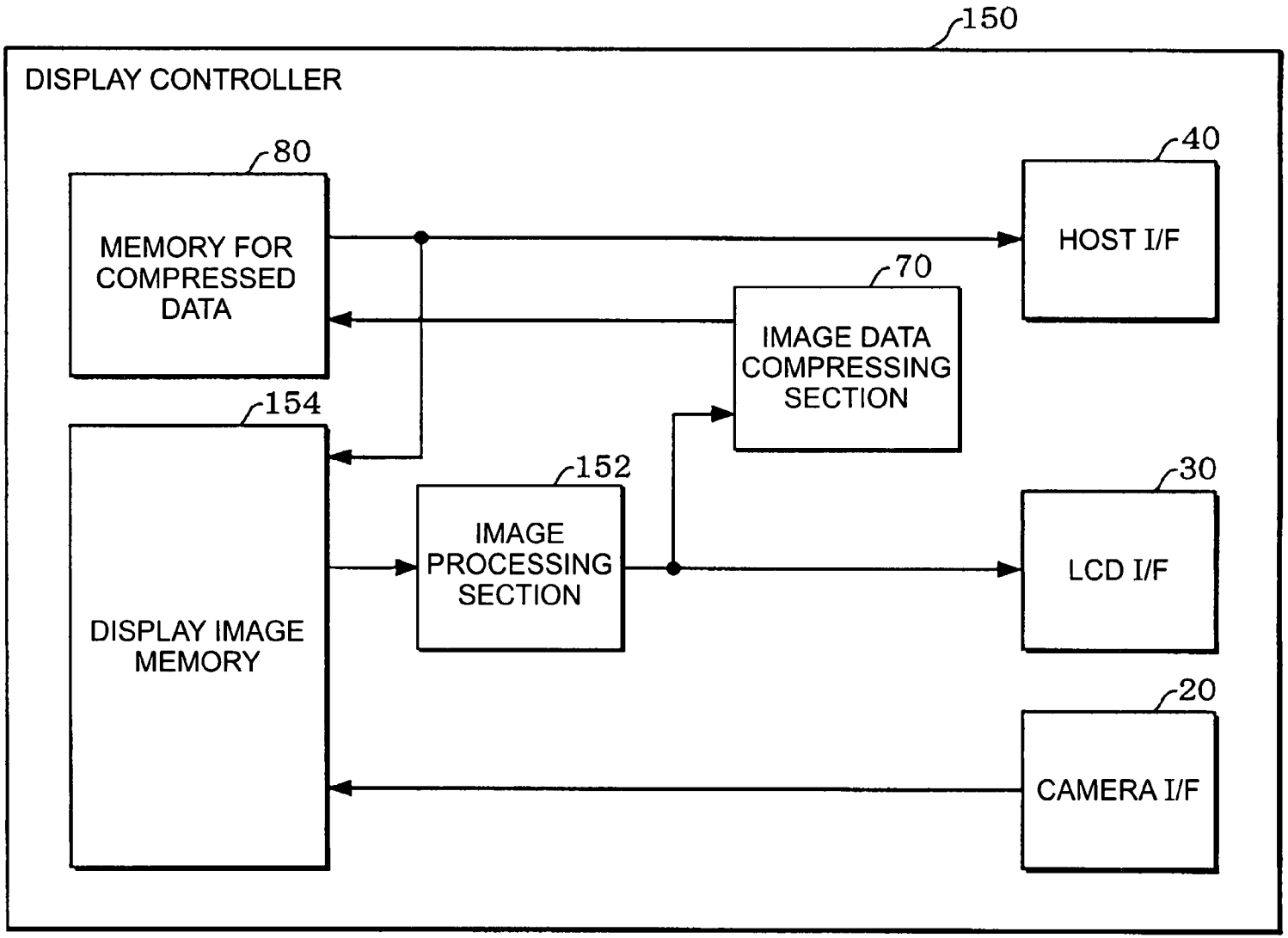
FIG. 2 shows a block diagram to illustrate a general structure of a display controller of a comparative example for the present embodiment.

FIG. 2 shows a block diagram to illustrate a general structure of a display controller of a comparative example for the present embodiment. Any section, which is the same as that of FIG. 1, is provided with the same reference numeral as given in FIG. 1, and explanation on the section is suitably omitted.

In the comparative example, a display controller 150 includes the camera I/F circuit 20, the LCD I/F circuit 30, the host I/F circuit 40, the image data compressing section 70, and the memory for compressed data 80. Furthermore, the display controller 150 includes an image processing section 152 and a display image memory 154. Image data from the camera I/F circuit 20 are stored in the display image memory 154, as they are. The image processing section 152 carries out a turning operation on image data read out of the display image memory 154, and outputs the image data after the turning operation to the image data compressing section 70 and the LCD I/F circuit 30.

That is to say; in the comparative example, the turning operation can be done with one turning angle for the image data of one frame. As a result, a problem described below comes up when the orientation of an image for compressing operation is different from the orientation of the display image to be output to the display driver.

Figure 3:
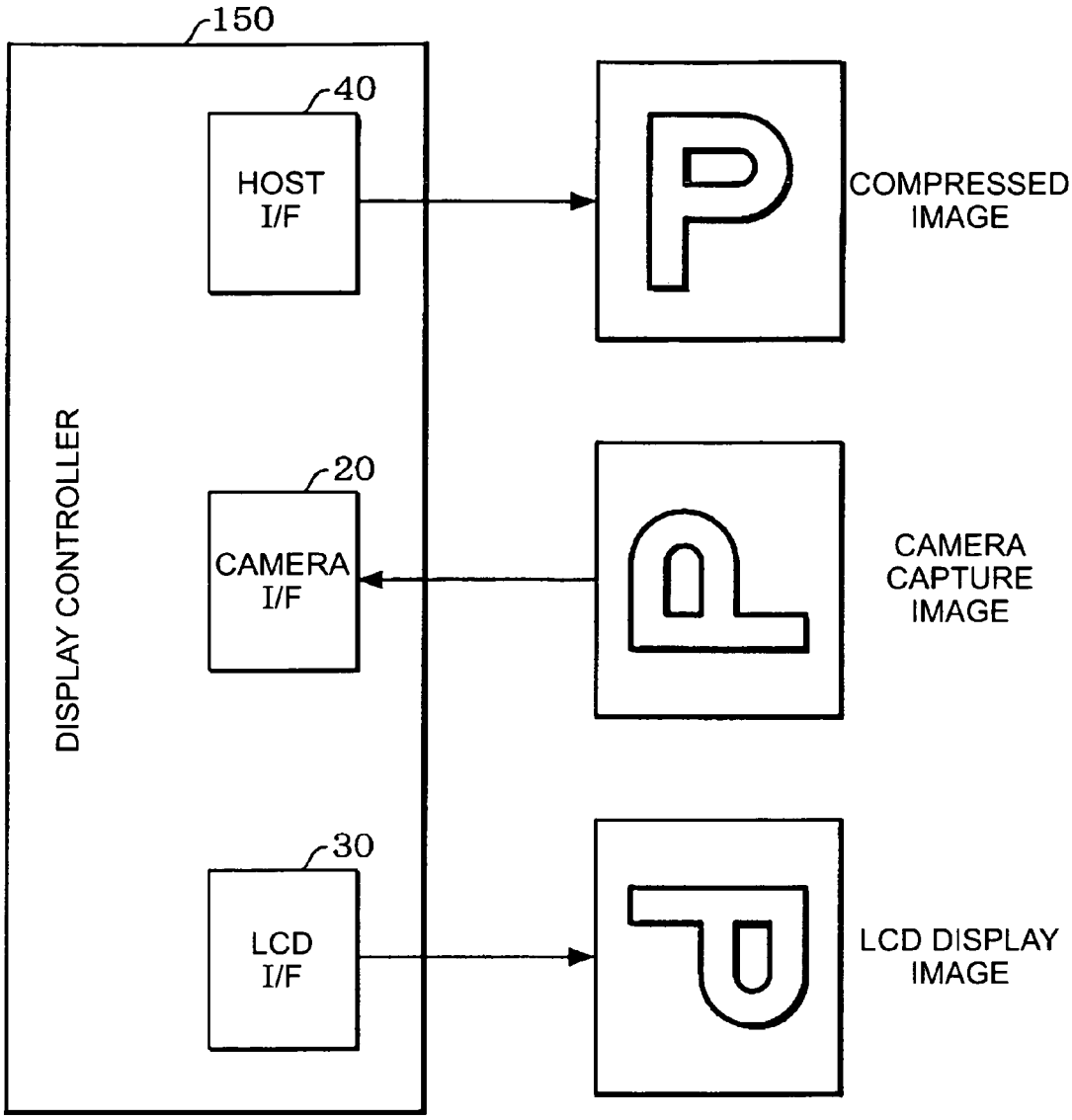
FIG. 3 shows a drawing to illustrate a case in which the orientation of the image for compressing operation is different from the orientation of the image for displaying.

FIG. 3 shows a drawing to illustrate a case in which the orientation of the image for compressing operation is different from the orientation of the image for displaying. FIG. 3 illustrates a case in which the orientation of the camera capture image grabbed by the camera module, the orientation of the image after compressing operation, and the orientation of the display image of the display panel are different from one another. The image data of the camera capture image is input through the camera I/F circuit 20 to the display controller 150. The image data of the image after compressing operation is output through the host I/F circuit 40. The image data of the display image is output through the LCD I/F circuit 30 to the display driver.

In this case, the display controller 150 in the comparative example illustrated by FIG. 2 can carry out a turning operation for the image data of one frame only with one turning angle, and cannot carry out any turning operation for the image data of the same frame with another different turning angle.

Figure 4A:
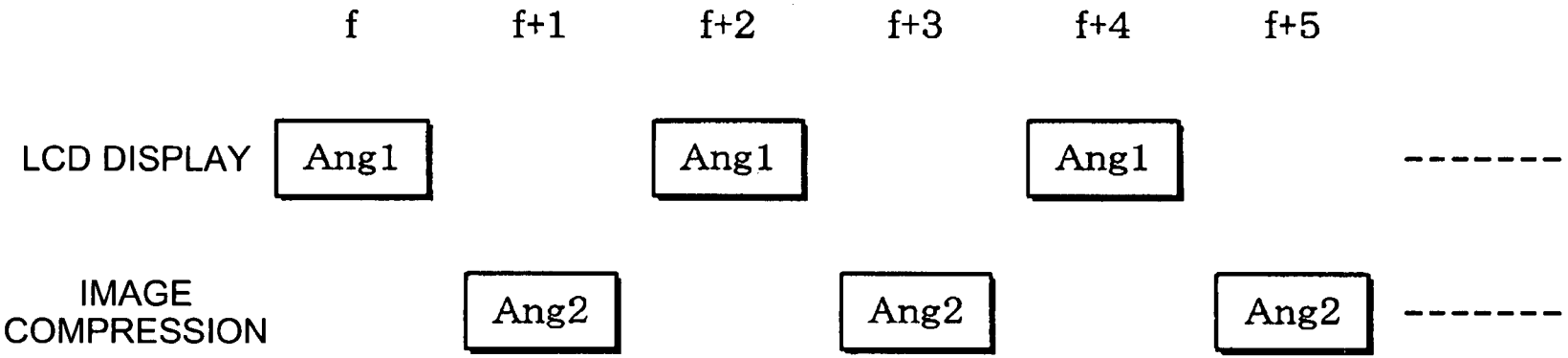
FIG. 4A and FIG. 4B shows drawings to explain the difference between the comparative example and the present embodiment.
Figure 4B:
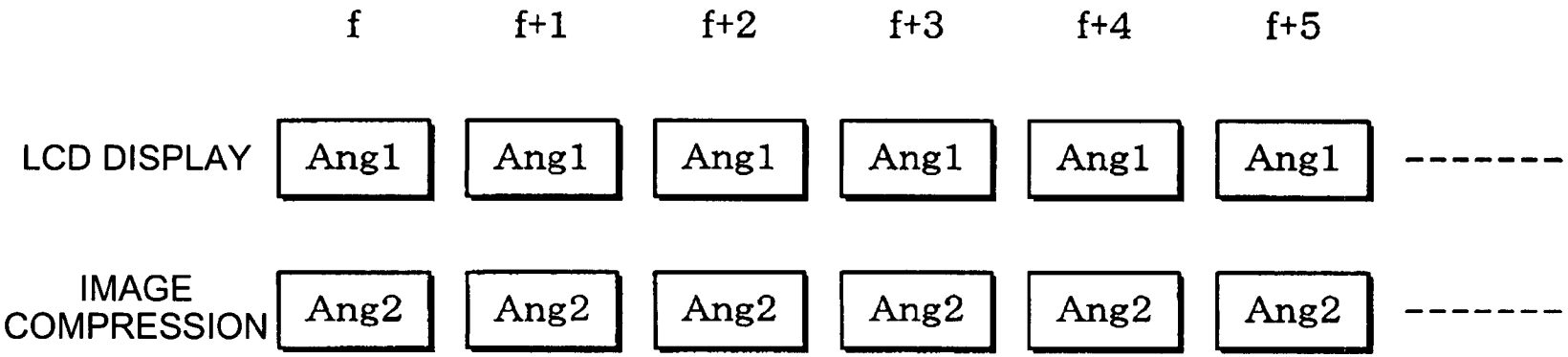

FIG. 4A and FIG. 4B shows drawings to graphically explain the difference between the comparative example and the present embodiment.

FIG. 4A shows a processing operation example for each of the continuous frames; f, f+1, f+2, - - - , of the comparative example. Meanwhile, FIG. 4B shows a processing operation example for each of the continuous frames; f, f+1, f+2, - - - , of the present embodiment. On this occasion, the turning angle for turning the display image is 'Ang1' and the turning angle for turning the compression image is 'Ang2'.

Since only a turning operation with one turning angle can be carried out for the image data of one frame in the comparative example, it is impossible to carry out a turning operation for the compression image by using the image data of the frame 'f' if once a turning operation for the display image of the frame 'f' is carried out with the turning angle 'Ang1'. Therefore, the turning operation for the compression image is carried out for the next frame 'f+1' with the turning angle 'Ang2'. Then, since the turning operation for the compression image is carried out for the frame 'f+1' with the turning angle 'Ang2', it is impossible to carry out a turning operation for the display image by using the image data of the frame 'f+1'.

Furthermore, the image data input through the camera I/F circuit 20 are stored in the display image memory 154, as they are. Therefore, it is indispensable to make the display image memory 154 have a large capacity, though the size of images for displaying and storing can be small.

On the other hand, in the case of the present embodiment, the first image processing section 50 and the second image processing section 60 individually carry out their own turning operation for the independently-prepared image data of the identical frame. Therefore, as shown in FIG. 4B, it becomes possible to create the image data by carrying out turning operations with the turning angles of 'Ang1' and 'Ang2' on the image data of a series of frames. As a result, the frame of the image to be displayed on the display panel and the frame of the image to be compressed for storing can be of the identical frame. Thus, it becomes possible to avoid any such circumstances where images captured by continuous shootings of the camera module and/or data saved as a motion picture become different from those displayed on the display panel.

Furthermore, since the image size of the image data input through the camera I/F circuit 20 is reduced by the first image size reducing section 90 and the second image size reducing section 100 before storing the data into each corresponding memory, the capacity of the display image memory and the compression image memory can become small.

Next, an example of the detailed hardware structure of the display controller in the present embodiment is described.

Figure 5:
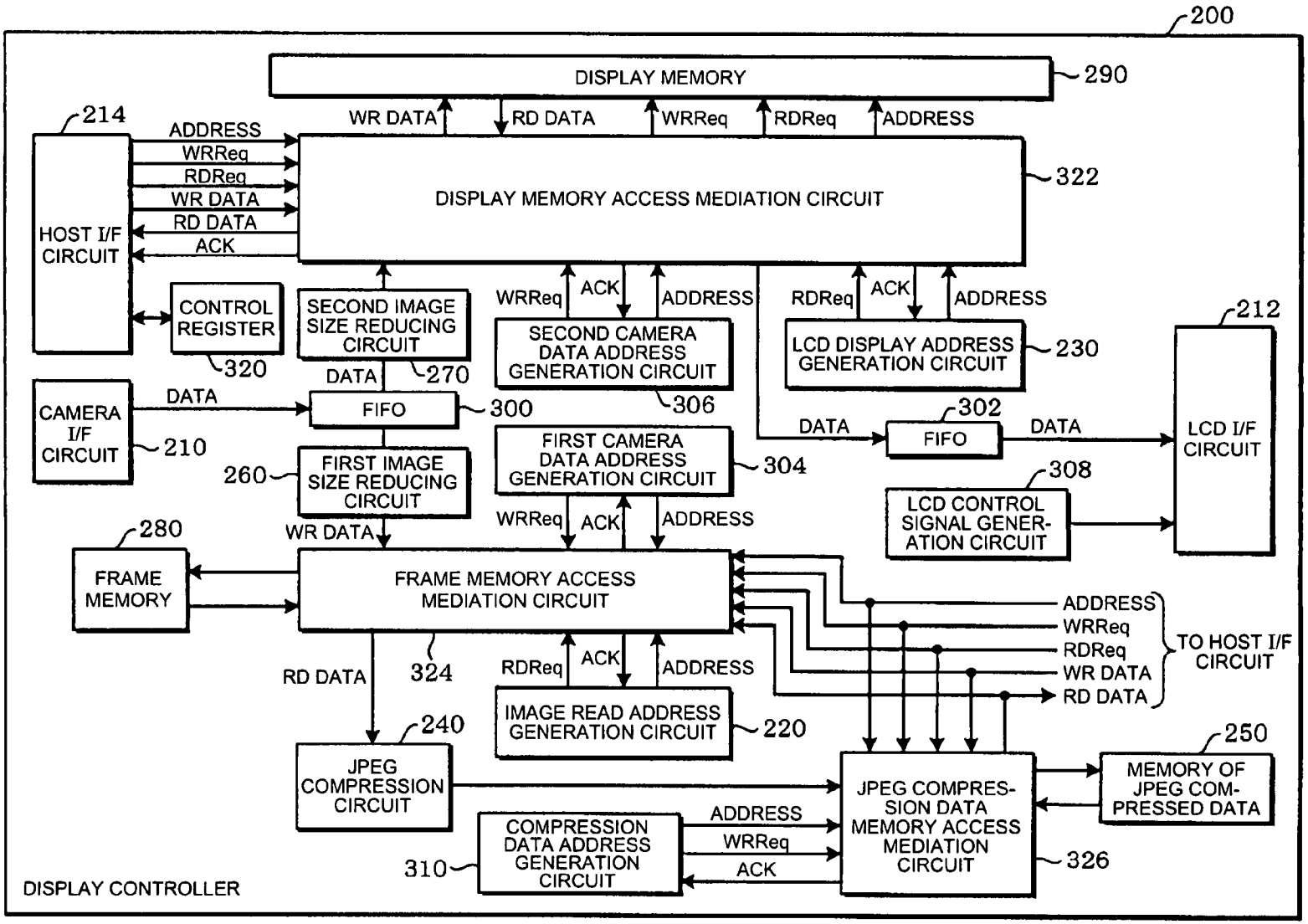
FIG. 5 shows a block diagram of an example of a detailed hardware structure of a display controller in the present embodiment.

FIG. 5 shows a block diagram of the example of the detailed hardware structure of the display controller in the present embodiment.

In a display controller 200, the function of the camera I/F circuit 20 shown in FIG. 1 is implemented by a camera I/F circuit 210. The function of the LCD I/F circuit 30 shown in FIG. 1 is implemented by an LCD I/F circuit 212. The function of the host I/F circuit 40 shown in FIG. 1 is implemented by a host I/F circuit 214. The function of the first image processing section 50 shown in FIG. 1 is implemented by an image read address generation circuit 220. The function of the second image processing section 60 shown in FIG. 1 is implemented by an LCD display address generation circuit 230. The function of the image data compressing section 70 shown in FIG. 1 is implemented by a JPEG compression circuit 240. The function of the memory for compressed data 80 shown in FIG. 1 is implemented by a memory of JPEG compressed data 250. The function of the first image size reducing section 90 shown in FIG. 1 is implemented by a first image size reducing circuit 260. The function of the second image size reducing section 100 shown in FIG. 1 is implemented by a second image size reducing circuit 270. The function of the compression image memory 110 shown in FIG. 1 is implemented by a frame memory 280. The function of the display image memory 120 shown in FIG. 1 is implemented by a display memory 290.

The display controller 200 further includes; an FIFO 300, an FIFO 302, a first camera data address generation circuit 304, a second camera data address generation circuit 306, an LCD control signal generation circuit 308, a compression data address generation circuit 310, a control register 320, a display memory access mediation circuit 322, a frame memory access mediation circuit 324, and a JPEG compression data memory access mediation circuit 326.

The display memory access mediation circuit 322 mediates access to the display memory 290 by the host I/F circuit 214, the second camera data address generation circuit 306, and the LCD display address generation circuit 230. The display memory access mediation circuit 322 mediates these multiple write request signals 'WRReq' and multiple read request signals 'RDReq'; and notifies the circuit, which is allowed to access as a result of the mediation, of the end of the access with an acknowledge signal 'ACK' corresponding to the request signal.

The frame memory access mediation circuit 324 mediates access to the frame memory 280 by the host I/F circuit 214, the first camera data address generation circuit 304, and the image read address generation circuit 220. The frame memory access mediation circuit 324 also mediates the multiple write request signals 'WRReq' and multiple read request signals 'RDReq'; and notifies the circuit, which is allowed to access as a result of the mediation, of the end of the access with an acknowledge signal 'ACK' corresponding to the request signal.

The JPEG compression data memory access mediation circuit 326 mediates access to the memory of JPEG compressed data 250 by the host I/F circuit 214, and the compression data address generation circuit 310. The JPEG compression data memory access mediation circuit 326 also mediates the multiple write request signals 'WRReq' and multiple read request signals 'RDReq'; and notifies the circuit, which is allowed to access as a result of the mediation, of the end of the access with an acknowledge signal 'ACK' corresponding to the request signal.

The FIFO 300 functions as a "First-In First-Out" memory circuit. The FIFO 300 works as a receiving buffer for the image data input into the camera I/F circuit 210; and outputs the image data, which the FIFO 300 takes in, to both the first image size reducing circuit 260 and the second image size reducing circuit 270.

The image data, reduced in the image size with the first reduction ratio by the first image size reducing circuit 260, are output to the frame memory access mediation circuit 324. The first camera data address generation circuit 304 generates a write request signal 'WRReq' and a write address in order to write the image data, which is output from the first image size reducing circuit 260 to the frame memory access mediation circuit 324, into the frame memory 280.

The image data, reduced in the image size with the second reduction ratio by the second image size reducing circuit 270, are output to the display memory access mediation circuit 322. The second camera data address generation circuit 306 generates a write request signal 'WRReq' and a write address in order to write the image data, which is output from the second image size reducing circuit 270 to the display memory access mediation circuit 322, into the display memory 290.

The FIFO 302 also functions as a "First-In First-Out" memory circuit. The FIFO 302 works as a sending buffer for the image data output from the display memory access mediation circuit 322, and outputs the image data, which the FIFO 302 takes in, to the LCD I/F circuit 212 in due order. The LCD display address generation circuit 230 generates a read request signal 'RDReq' and a read address in order to read out of the display memory 290 and output to the FIFO 302. At this time, the LCD display address generation circuit 230 generates a read address in order to create an image by turning the image orientation with the second turning angle and/or by a mirror image reversing operation. The LCD control signal generation circuit 308 generates LCD control signals as display synch signals; such as a vertical synch signal, a horizontal synch signal, and a dot clock signal and so on, which are supplied to the display driver together with the image data to be output from the FIFO 302.

The image read address generation circuit 220 generates a read request signal 'RDReq' and a read address in order to read out of the frame memory 280 and output to the JPEG compression circuit 240. At this time, the image read address generation circuit 220 generates a read address in order to create an image by turning the image orientation with the first turning angle and/or by a mirror image reversing operation.

The JPEG compression circuit 240 carries out a compressing operation, specified according to the standards of JPEG, for the image data coming from the frame memory 280, and outputs the data to the JPEG compression data memory access mediation circuit 326. The compression data address generation circuit 310 generates a write request signal 'WRReq' and a write address in order to write the image data, which is output from the JPEG compression circuit 240 to the JPEG compression data memory access mediation circuit 326, into the memory of JPEG compressed data 250.

Control data for controlling the display controller 200 are set in the control register 320, and each section of the display controller 200 is controlled according to the control data set in the control register 320.

Next, some key sections of the display controller 200 that FIG. 5 shows are described.

Figure 6:
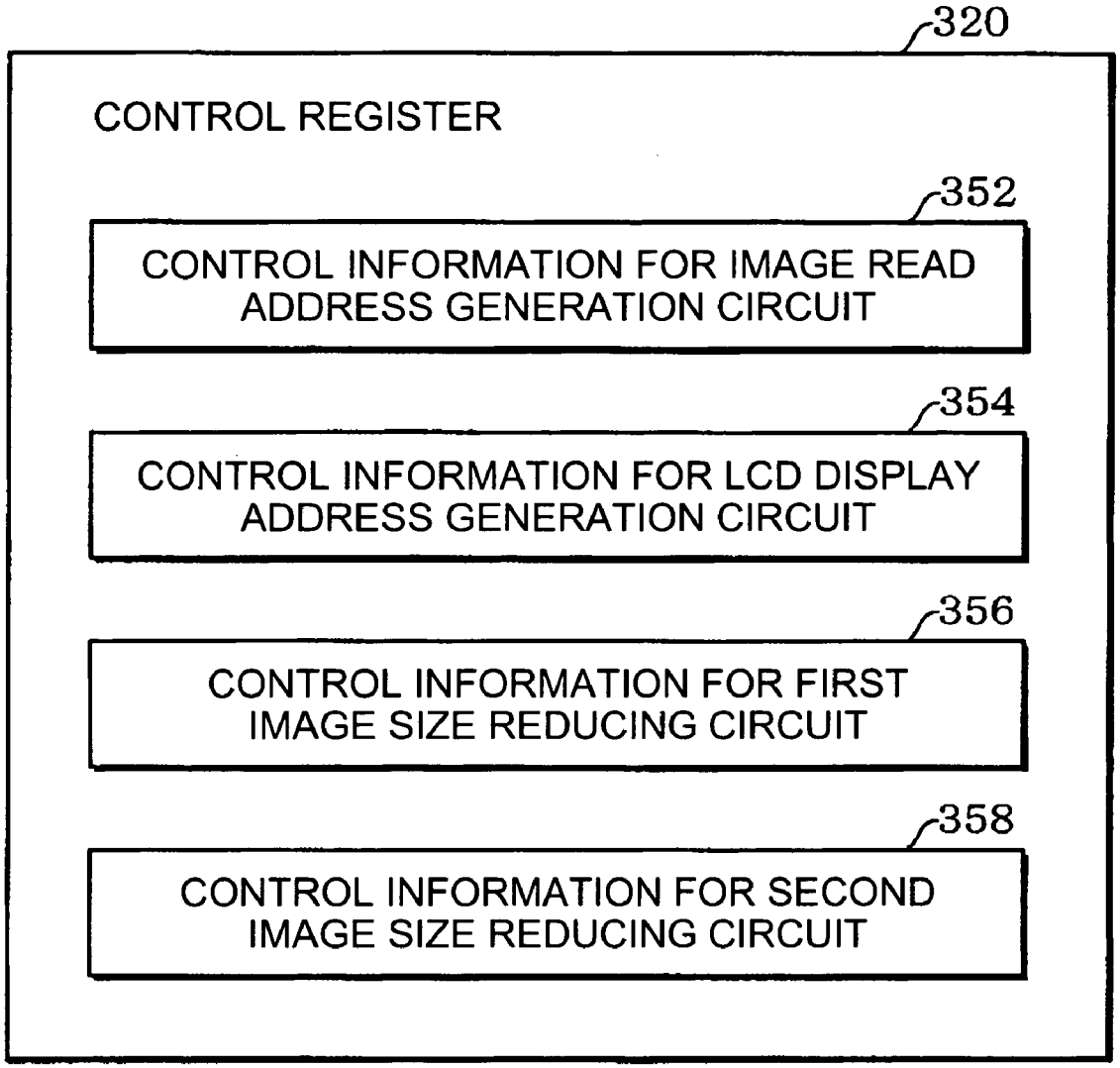
FIG. 6 shows a block diagram to illustrate an example of a structure of the control register shown in FIG. 5.

FIG. 6 shows a block diagram to illustrate an example of a structure of the control register 320 shown in FIG. 5.

The control register 320 includes; an image read address control register 352, a display address control register 354, a first image size reduction control register 356, and a second image size reduction control register 358. In the image read address control register 352; for example, control information for the image read address generation circuit, which the host sets through the host I/F circuit 214, is stored. In the display address control register 354; for example, control information for the LCD display address generation circuit, which the host sets through the host I/F circuit 214, is stored. In the first image size reduction control register 356; for example, control information for the first image size reducing circuit, which the host sets through the host I/F circuit 214, is stored. In the second image size reduction control register 358; for example, control information for the second image size reducing circuit, which the host sets through the host I/F circuit 214, is stored. The control information, which each control register stores, is described later.

Figure 7:
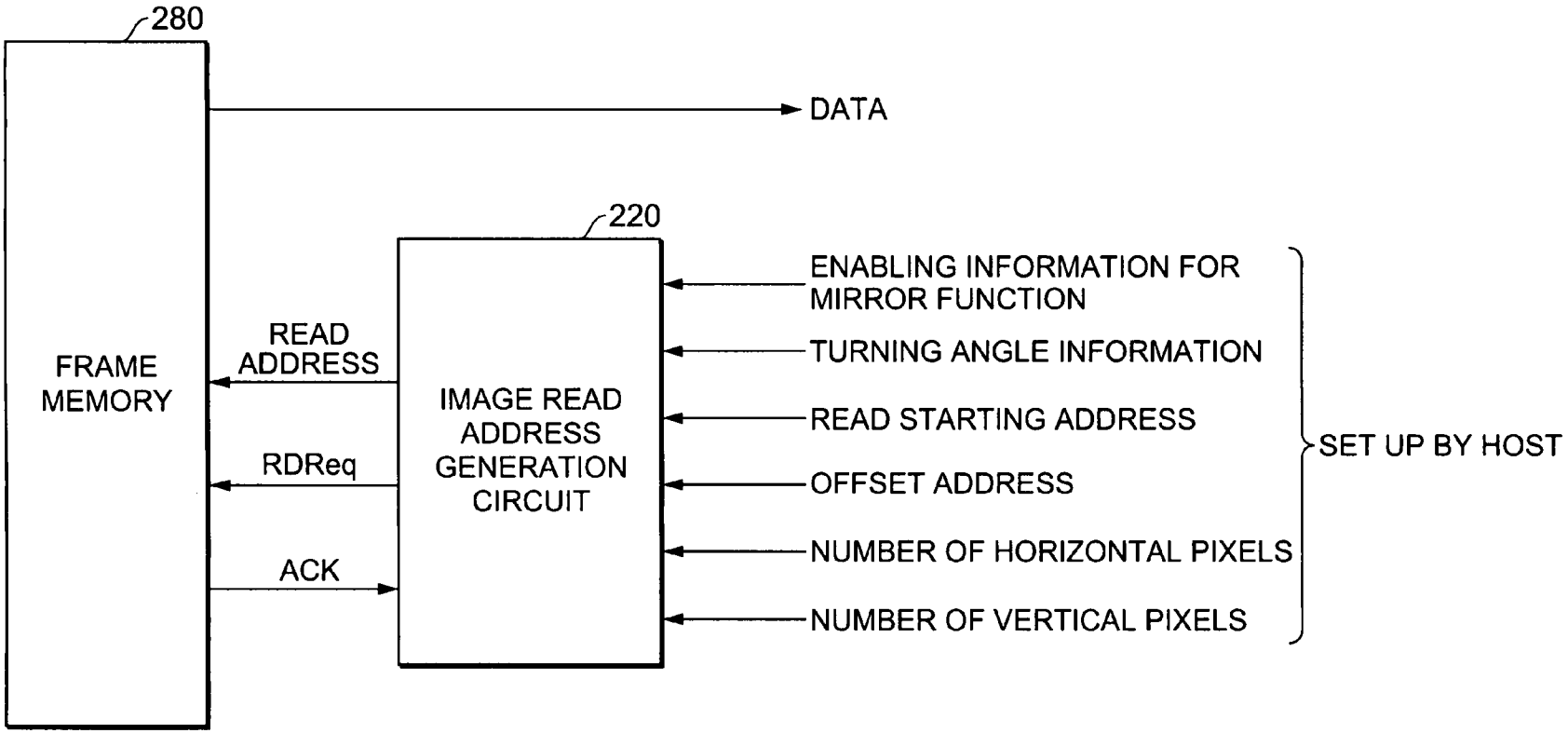
FIG. 7 illustrates an outline of a structure of an image read address generation circuit.

FIG. 7 illustrates an outline of a structure of the image read address generation circuit 220. FIG. 7 graphically shows a relationship of a connection between the frame memory 280 and the image read address generation circuit 220. The image read address generation circuit 220 implements the function of the first image processing section 50 shown in FIG. 1.

Into the image read address generation circuit 220; enabling information for the mirror function, turning angle information, a read starting address, an offset address, the number of horizontal pixels, and the number of vertical pixels are input. These pieces of information are set by the host. The host sets these pieces of information as the control information for the image read address generation circuit into the image read address control register 352 of the control register 320. Then the image read address generation circuit 220 determines the read address according to the control information for the image read address generation circuit, and outputs a read request signal 'RDReq' for reading data out of the frame memory 280. The image read address generation circuit 220 is notified of the end of the access with an acknowledge signal 'ACK' from the frame memory 280, corresponding to the read request signal 'RDReq' described above.

Figure 8:
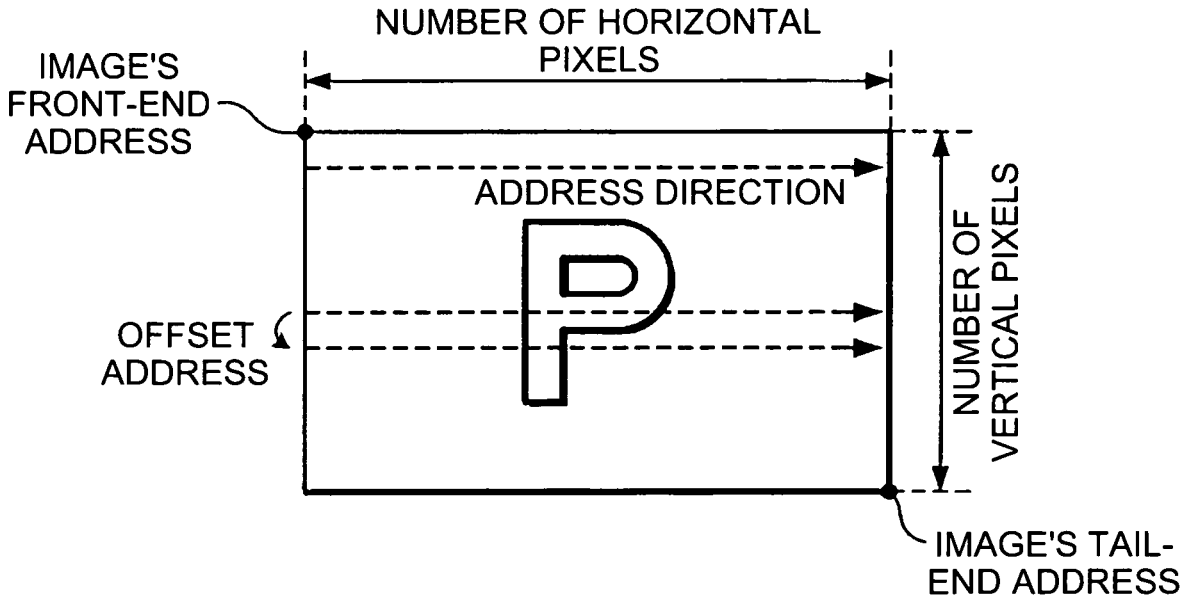
FIG. 8 shows a drawing to describe control information for an image read address generation circuit.

FIG. 8 shows a drawing to describe the control information for the image read address generation circuit.

In the following descriptions, it is assumed that a first turning angle can be set among only the choices of 0 degrees, 90 degrees, 180 degrees, and 270 degrees; and it can be specified whether or not a mirror image reversing operation is implemented at the turning angle set among the choices.

In the frame memory 280; image data of each pixel of a rectangular image, whose numbers of pixels in the horizontal direction and the vertical direction are as specified with the number of horizontal pixels and the number of vertical pixels, respectively, are stored in an memory area for the data from the image's front-end address to the image's tail-end address. Image data of each pixel in the horizontal direction are stored in a memory area of the frame memory 280, which is specified by an address updated with reference to the front-end address of each line in the horizontal direction.

The tail-end address of a line in the horizontal direction does not necessarily need to be continuously followed by the front-end address of the next line, and the address interval between the front-end address of a line and that of the next line is defined as an offset address. By the way, in the case where the tail-end address of a line is continuously followed by the front-end address of the next line, the offset address is 0.

In the control information for the image read address generation circuit, the enabling information for the mirror function is information to specify whether or not a mirror image reversing operation is implemented, and the turning angle information is information to specify the first turning angel. Meanwhile, the read starting address is the first read address for reading the image data out of the frame memory 280.

The host needs to specify the read starting address and the offset address, according to the turning angle and the enabling information for the mirror function.

FIG. 9A to FIG. 9D and FIG. 10A to FIG. 10D are drawings to explain setup examples of the read starting address and the offset address according to the turning angle and the enabling information for the mirror function. On this occasion, condition of each image after the first processing operation is graphically indicated.

Figure 9A:
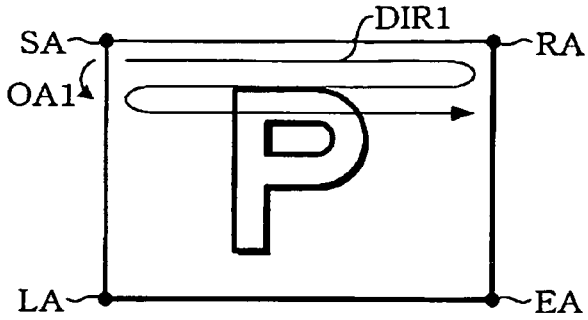
FIG. 9A to FIG. 9D are drawings to explain setup examples of read starting addresses and offset addresses according to turning angles and enabling information for the mirror function.

FIG. 9A graphically shows the read starting address, the updating direction of the read address, and the offset address, in a case where the first turning angle is 0 degrees, and the mirror function is set to be disabled (OFF). In this case, the orientation of the image after the first processing operation is the same as that before the first processing operation. Therefore, the address at the upper left position is set as the read starting address 'SA', and then the read address gets updated in the updating direction 'DIR1'. When the read address reaches the tail-end address in the updating direction, the front-end read address of the next line is calculated by using the offset address 'OA1'. Thus, the pixels of one line read out in this manner are handled as the pixels of one line in the horizontal direction of the image for compressing operation.

Figure 9B:
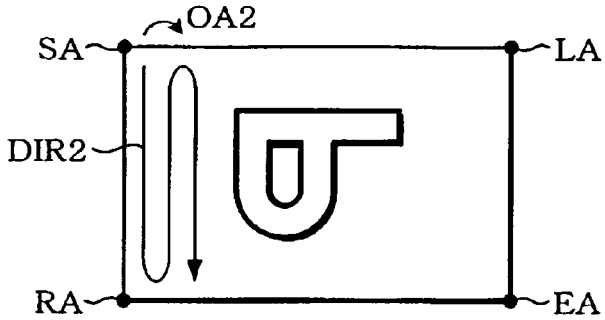

FIG. 9B graphically shows the read starting address, the updating direction of the read address, and the offset address, in a case where the first turning angle is 90 degrees, and the mirror function is set to be enabled (ON). In this case, the address at the upper left position is set as the read starting address 'SA', and then the read address gets updated in the updating direction 'DIR2'. When the read address reaches the tail-end address in the updating direction, the front-end read address of the next line is calculated by using the offset address 'OA2'. Thus, the pixels of one line read out in this manner are handled as the pixels of one line in the horizontal direction of the image for compressing operation.

Figure 9C:
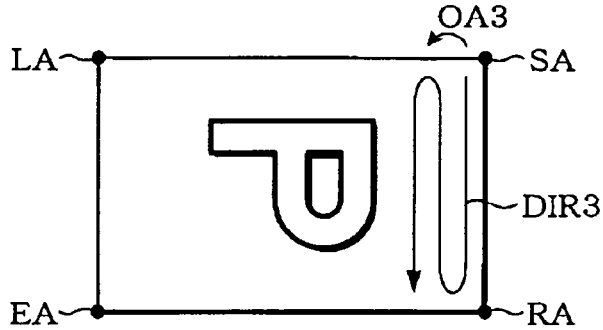

FIG. 9C graphically shows the read starting address, the updating direction of the read address, and the offset address, in a case where the first turning angle is 90 degrees, and the mirror function is set to be disabled.

Figure 9D:
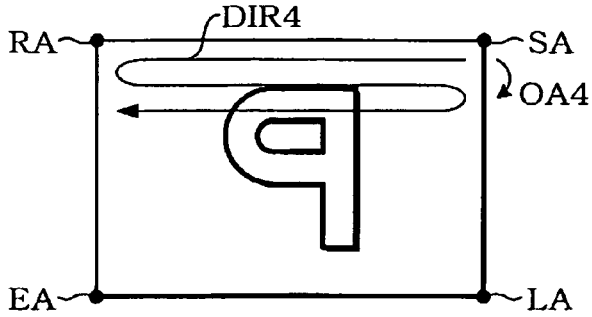

FIG. 9D graphically shows the read starting address, the updating direction of the read address, and the offset address, in a case where the first turning angle is 0 degrees, and the mirror function is set to be enabled.

Figure 10A:
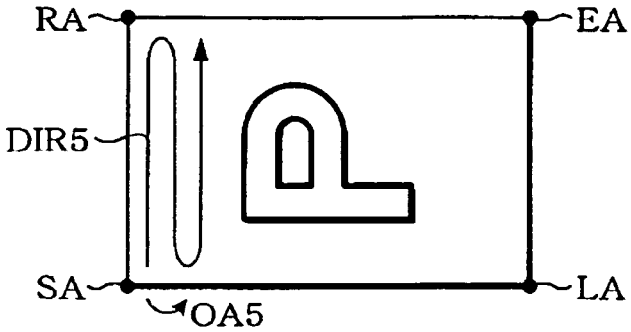
FIG. 10A to FIG. 10D are drawings to explain setup examples of read starting addresses and offset addresses according to turning angles and enabling information for the mirror function.

FIG. 10A graphically shows the read starting address, the updating direction of the read address, and the offset address, in a case where the first turning angle is 270 degrees, and the mirror function is set to be disabled.

Figure 10B:
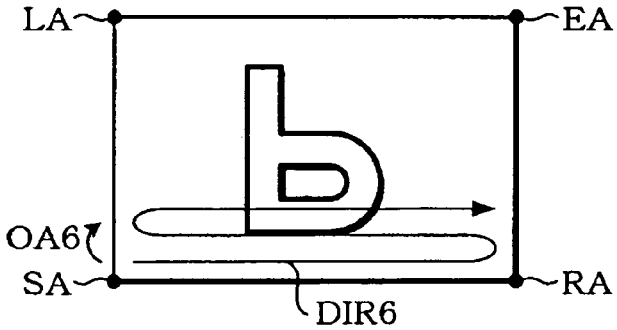

FIG. 10B graphically shows the read starting address, the updating direction of the read address, and the offset address, in a case where the first turning angle is 180 degrees, and the mirror function is set to be enabled.

Figure 10C:
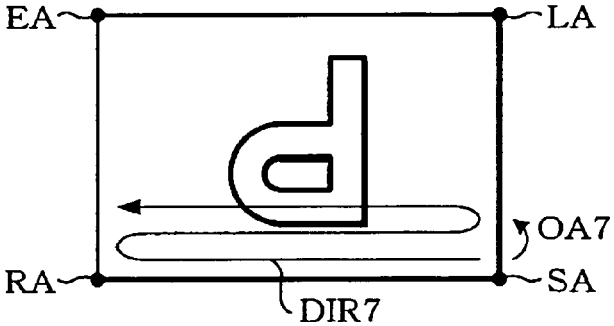

FIG. 10C graphically shows the read starting address, the updating direction of the read address, and the offset address, in a case where the first turning angle is 180 degrees, and the mirror function is set to be disabled.

Figure 10D:
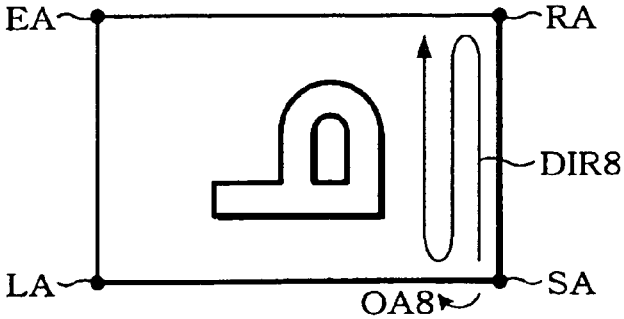

FIG. 10D graphically shows the read starting address, the updating direction of the read address, and the offset address, in a case where the first turning angle is 270 degrees, and the mirror function is set to be enabled.

In the same manner as described for FIG. 9A and FIG. 9B; also in all the cases of FIG. 9C, FIG. 9D, and FIG. 10A to FIG. 10D, the read address is calculated and the pixels of one line read out by using the read address are handled as the pixels of one line in the horizontal direction of the image for compressing operation.

Figure 11:
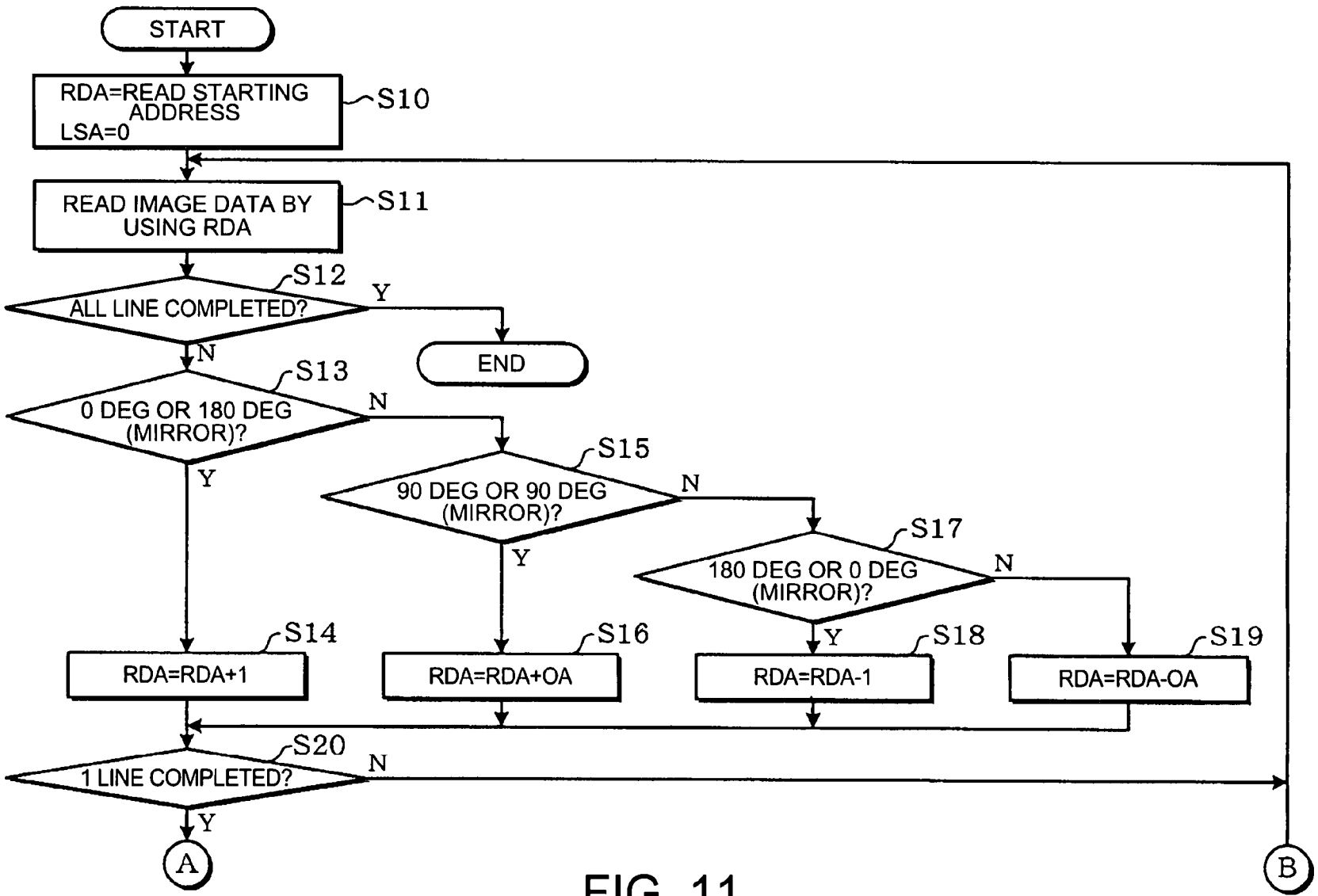
FIG. 11 shows the first half of an operation flowchart of the image read address generation circuit illustrated in FIG. 7.
Figure 12:
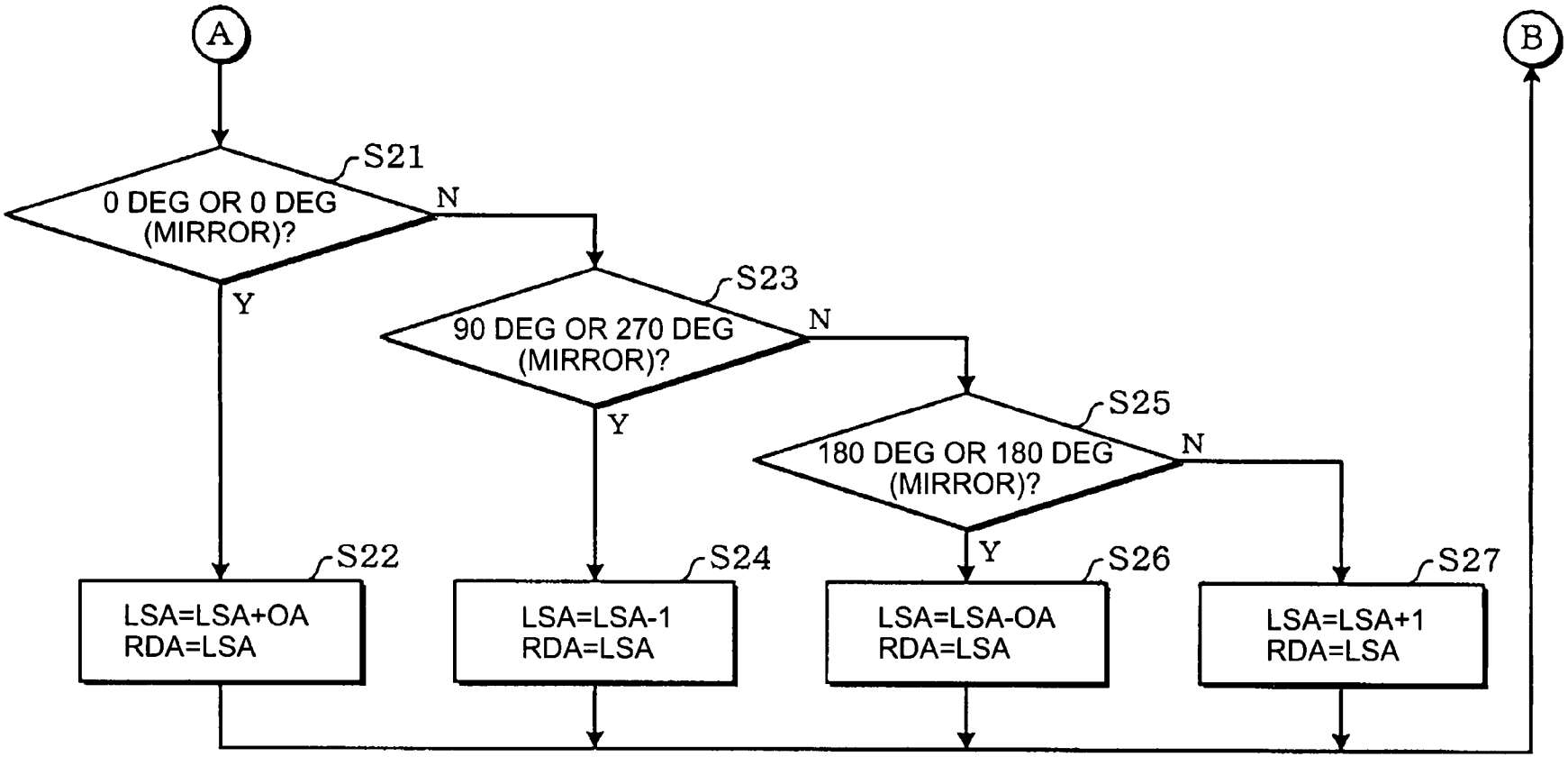
FIG. 12 shows the second half of an operation flowchart of the image read address generation circuit illustrated in FIG. 7.

FIG. 11 and FIG. 12 show an operation flowchart of the image read address generation circuit illustrated in FIG. 7. On this occasion, it is assumed for convenience in explanation that image data for one pixel are stored in a memory area specified with one address Regarding the first turning angle and the enabling information for the mirror function in the following explanation, only the value of the first turning angle is indicated. Furthermore, only when the mirror function is enabled, an additional note '(Mirror)' is simply added after the value of the first turning angle. For example, an expression '0 deg' means that the first turning angle is 0 degrees and the mirror function is disabled. In another case, an expression '180 deg (Mirror)' means that the first turning angle is 180 degrees and the mirror function is enabled.

As shown in FIG. 9A to FIG. 9D as well as FIG. 10A to 10D, at first the read starting address set by the host according to the first turning angle and the enabling information for the mirror function is set for the read address 'RDA' and the variable 'LSA' is initialized to be 0 (at the step 'S10').

Next, by using the read address 'RDA', image data are read out of the frame memory 280 (at the step 'S11').

When reading all the lines is completed (at the step 'S12": Y), a series of operations comes to an end ('End').

When reading all the lines is not completed yet at the step 'S12' (at the step 'S12': N), it is determined whether '0 deg' or '180 deg (Mirror)' is set or not (at the step 'S13').

When it is determined at the step 'S13' that '0 deg' or '180 deg (Mirror)' is set (at the step 'S13': Y), the read address 'RDA' adds 1 to the address value to update the read address 'RDA' (at the step 'S14').

When it is determined at the step 'S13' that neither '0 deg' nor '180 deg (Mirror)' is set (at the step 'S13': N), it is determined whether '90 deg' or '90 deg (Mirror)' is set or not (at the step 'S15').

When it is determined at the step 'S15' that '90 deg' or '90 deg (Mirror)' is set (at the step 'S15': Y), the read address 'RDA' adds the offset address 'OA' to the address value to update the read address 'RDA' (at the step 'S16'). On this occasion, the offset address 'OA' is set by the host according to the first turning angle and the enabling information for the mirror function, as shown in FIG. 9A to FIG. 9D as well as FIG. 10A to 10D.

When it is determined at the step 'S15' that neither '90 deg' nor '90 deg (Mirror)' is set (at the step 'S15': N), it is determined whether '180 deg' or '0 deg (Mirror)' is set or not (at the step 'S17').

When it is determined at the step 'S17' that '180 deg' or '0 deg (Mirror)' is set (at the step 'S17': Y), the read address 'RDA' deducts 1 from the address value to update the read address 'RDA' (at the step 'S18').

When it is determined at the step 'S17' that neither '180 deg' nor '0 deg (Mirror)' is set (at the step 'S17': N), it is considered that '270 deg' or '270 deg (Mirror)' is set. Then, the read address 'RDA' deducts the offset address 'OA' from the address value to update the read address 'RDA' (at the step 'S19').

Following to the step 'S14', step 'S16', step 'S18', and step 'S19'; it is determined whether reading one line is completed or not (at the step 'S20'). When it is determined that reading one line is not completed yet (at the step 'S20': N), the operation returns to the step 'S11' to continue reading image data.

When it is considered at the step 'S20' that reading one line is completed (at the step 'S20': Y), it is determined whether '0 deg' or '0 deg (Mirror)' is set or not (at the step 'S21').

When it is determined at the step 'S21' that '0 deg' or '0 deg (Mirror)' is set (at the step 'S21': Y), the offset address 'OA' is added to the variable 'LSA' to update the variable 'LSA' and the variable 'LSA' is set for the read address 'RDA' (at the step 'S22'). Then, the operation returns to the step 'S11'.

When it is determined at the step 'S21' that neither '0 deg' nor '0 deg (Mirror)' is set (at the step 'S21': N), it is determined whether '90 deg' or '270 deg (Mirror)' is set or not (at the step 'S23').

When it is determined at the step 'S23' that '90 deg' or '270 deg (Mirror)' is set (at the step 'S23': Y), the variable 'LSA' deducts 1 from the address value to update the variable 'LSA' and the variable 'LSA' is set for the read address 'RDA' (at the step 'S24'). Then, the operation returns to the step 'S11'.

When it is determined at the step 'S23' that neither '90 deg' nor '270 deg (Mirror)' is set (at the step 'S23': N), it is determined whether '180 deg' or '180 deg (Mirror)' is set or not (at the step 'S25').

When it is determined at the step 'S25' that '180 deg' or '180 deg (Mirror)' is set (at the step 'S25': Y), the offset address 'OA' is deducted from the variable 'LSA' to update the variable 'LSA' and the variable 'LSA' is set for the read address 'RDA' (at the step 'S26'). Then, the operation returns to the step 'S11'.

When it is determined at the step 'S25' that neither '180 deg' nor '180 deg (Mirror)' is set (at the step 'S25': N), it is considered that '270 deg' or '90 deg (Mirror)' is set. Then, the variable 'LSA' adds 1 to the address value to update the variable 'LSA' and the variable 'LSA' is set for the read address 'RDA' (at the step 'S27'). Then, the operation returns to the step 'S11'.

The above explanation is made for the image read address generation circuit 220 that works as the first image processing section 50, and the same can be said for the LCD display address generation circuit 230 that works as the second image processing section 60. Replacing the operation of reading out of the frame memory 280 with that of reading out of the display memory 290 enables the LCD display address generation circuit 230 to implement the same, and therefore, explanation on the structure and operation of the LCD display address generation circuit 230 is omitted. Also in the case of the LCD display address generation circuit 230; enabling information for the mirror function, turning angle information, a read starting address, an offset address, the number of horizontal pixels, and the number of vertical pixels are input into the LCD display address generation circuit 230. These pieces of information are set by the host. The host sets these pieces of information as the control information for the LCD display address generation circuit into the display address control register 354 of the control register 320.

Next, the first image size reducing circuit 260 shown in FIG. 5 is described.

Figure 13:
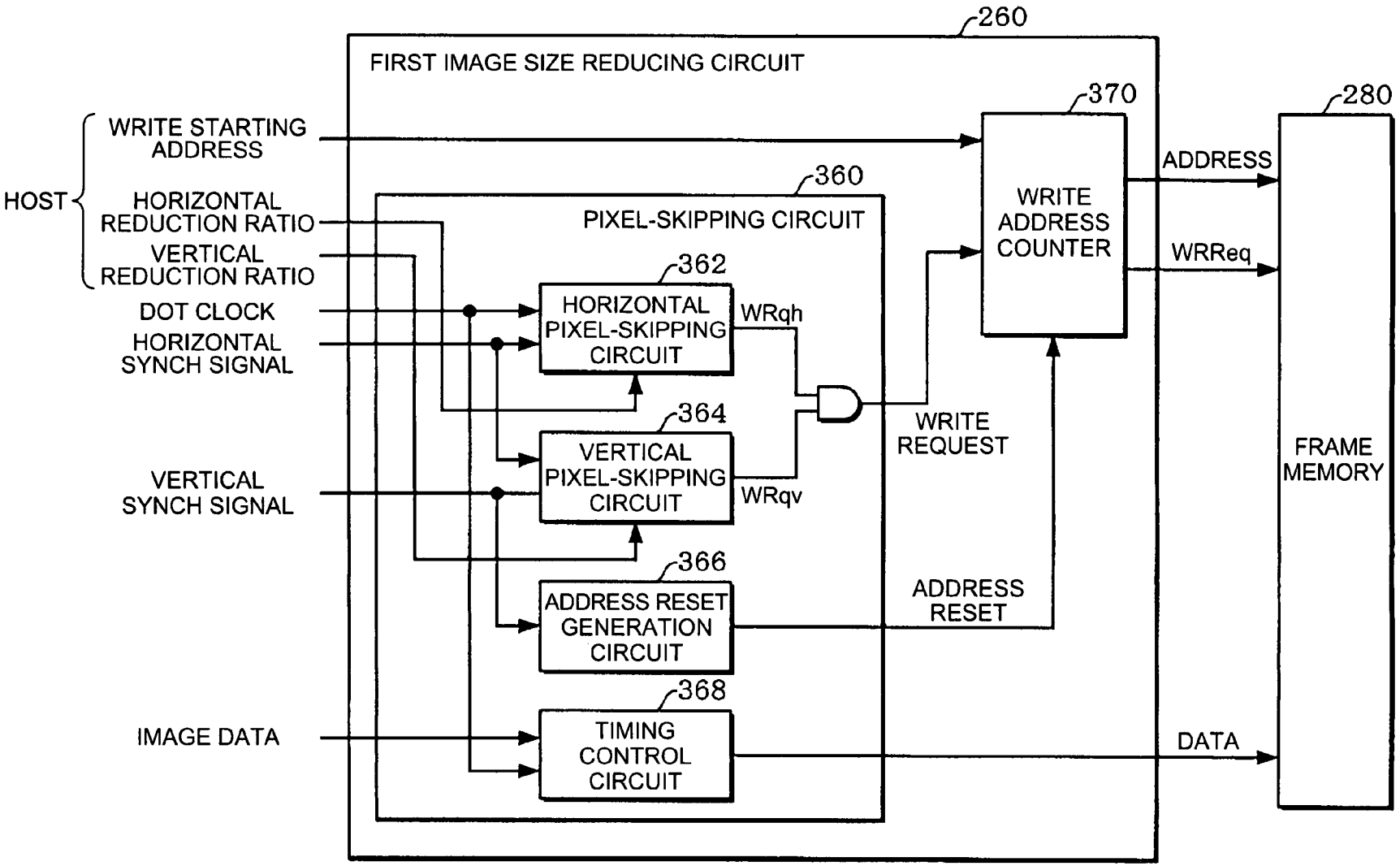
FIG. 13 shows a block diagram to illustrate an example of a structure of the first image size reducing circuit shown in FIG. 5.

FIG. 13 shows a block diagram to illustrate an example of a structure of the first image size reducing circuit 260. FIG. 13 graphically shows a relationship of a connection between the frame memory 280 and the first image size reducing circuit 260. The first image size reducing circuit 260 implements the function of the first image size reducing section 90 shown in FIG. 1.

Into the first image size reducing circuit 260, a write starting address and a first reduction ratio specified with a horizontal reduction ratio and a vertical reduction ratio are input. These pieces of information are set by the host. The host sets these pieces of information as the control information for the first image size reducing circuit into the first image size reduction control register 356 of the control register 320.

The write starting address is a first write address for writing image data into the frame memory 280. The horizontal reduction ratio is a reduction ratio for the image in the horizontal direction, and it is a decimal fraction that is greater than 0 but smaller than 1. Meanwhile, the vertical reduction ratio is a reduction ratio for the image in the vertical direction, and it is a decimal fraction that is greater than 0 but smaller than 1.

The first image size reducing circuit 260 includes a pixel-skipping circuit 360, and a write address counter 370. The pixel-skipping circuit 360 creates image data of an image reduced in size in the horizontal direction by skipping pixels laid out in the horizontal direction according to the horizontal reduction ratio. Meanwhile, pixel-skipping circuit 360 creates image data of an image reduced in size in the vertical direction by skipping pixels laid out in the vertical direction according to the vertical reduction ratio. The write address counter 370 outputs the write starting address according to address-resetting from the pixel-skipping circuit 360, and adds 1 to each address value in due order from the write starting address, output by the host, at specified timing within a period where the write request from the pixel-skipping circuit 360 is at the level 'H'.

The pixel-skipping circuit 360 includes a horizontal pixel-skipping circuit 362, a vertical pixel-skipping circuit 364, an address reset generation circuit 366, and a timing control circuit 368. A dot clock signal, a vertical synch signal, a horizontal synch signal, and image data from the FIFO 300 are input into the pixel-skipping circuit 360, in addition to the horizontal reduction ratio and the vertical reduction ratio.

Figure 14:
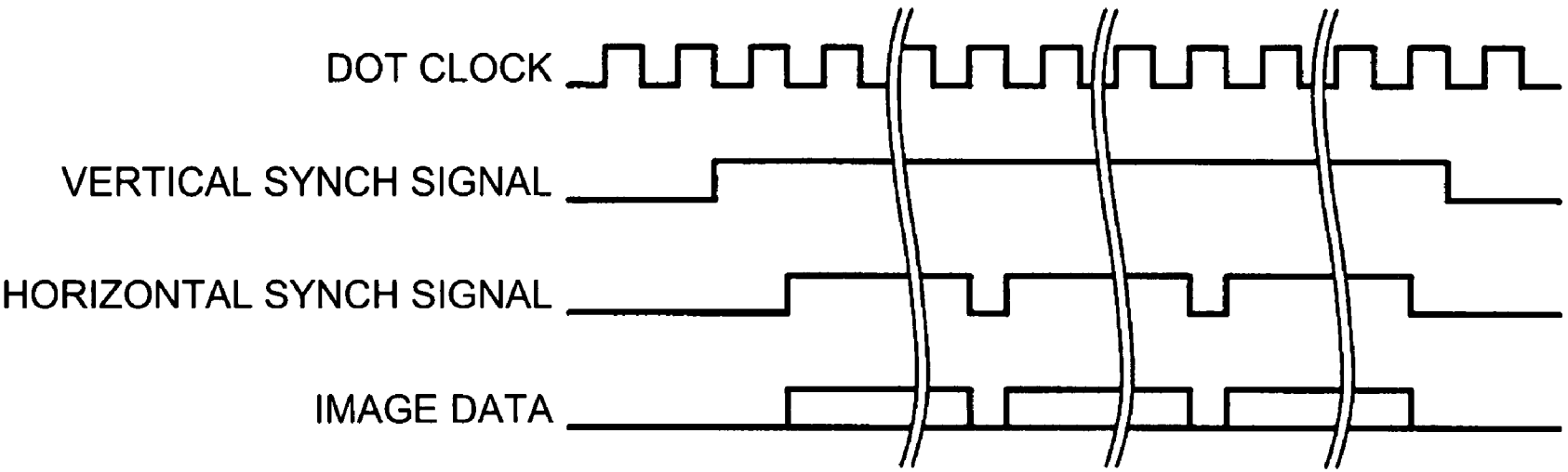
FIG. 14 shows an example of timing relationships of a dot clock, a horizontal synch signal, a vertical synch signal, and image data.

FIG. 14 shows an example of timing relationships of a dot clock signal, a vertical synch signal, a horizontal synch signal, and image data.

LCD control signals such as the dot clock signal, vertical synch signal, and horizontal synch signal are generated, for example, by the LCD control signal generation circuit 308. The vertical synch signal is a signal to define a vertical scanning period, and a period with the vertical synch signal being at its level 'H' is a vertical scanning period. The horizontal synch signal is a signal to define a horizontal scanning period, and a period with the horizontal synch signal being at its level 'H' is a horizontal scanning period. In a horizontal scanning period, image data of each pixel are input into the pixel-skipping circuit 360 in due order, while synchronizing with the dot clock signal.

In FIG. 13; the horizontal pixel-skipping circuit 362 generates a horizontal write request "WRqh', which gets the level 'H' only for the period according to the horizontal reduction ratio, in a horizontal scanning period specified by the horizontal synch signal. On the other hand, the vertical pixel-skipping circuit 364 generates a vertical write request "WRqv', which gets the level 'H' only for the period according to the vertical reduction ratio, in a vertical scanning period specified by the vertical synch signal. A write request to the write address counter 370 is generated by a logical product operation with a horizontal write request "WRqh' and a vertical write request "WRqv'.

The address reset generation circuit 366 consists of a rising signal edge detection circuit. The address reset generation circuit 366 detects a rising signal edge of the vertical synch signal and outputs an address reset at the time.

The timing control circuit 368 consists of a data latch. The timing control circuit 368 latches image data in synchronization with the dot clock to output them as write data.

Figure 15:
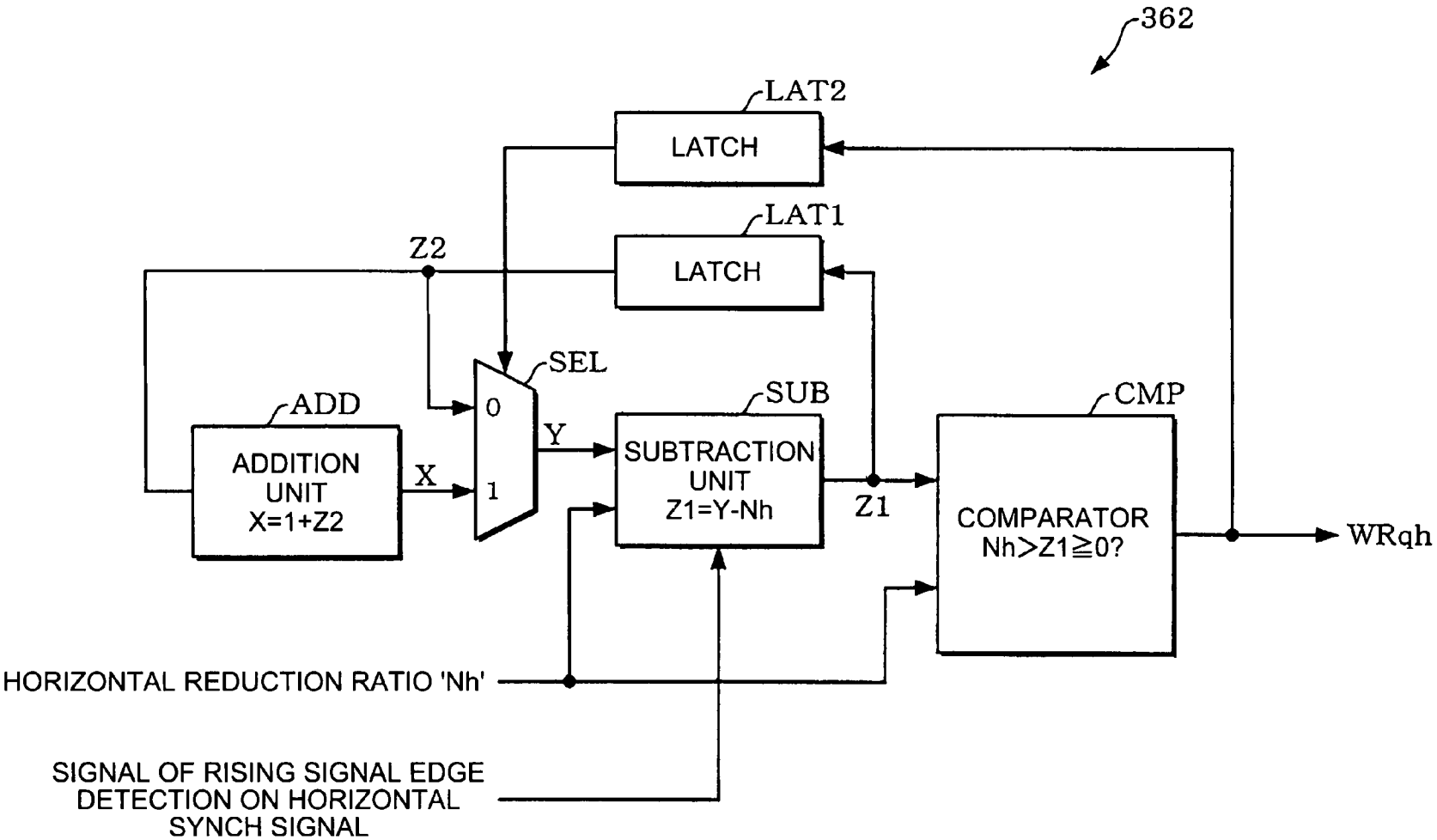
FIG. 15 shows a block diagram to illustrate an example of a structure of the horizontal pixel-skipping circuit shown in FIG. 13.

FIG. 15 shows a block diagram to illustrate an example of a structure of the horizontal pixel-skipping circuit 362.

Each section of the horizontal pixel-skipping circuit 362 operates in synchronization with the dot clock.

A subtraction unit 'SUB' outputs an output 'Z1' calculated as a decimal fraction by subtracting a horizontal reduction ratio 'Nh' from an input 'Y'. The subtraction unit 'SUB' initializes the output 'Z1' to be 0 in synchronization with a signal of the rising signal edge detection on the horizontal synch signal.

A latch 'LAT1' latches the output 'Z1' from the subtraction unit 'SUB'. Then, an output 'Z2' from the latch 'LAT1' is output to a selector 'SEL' and an addition unit 'ADD'.

The addition unit 'ADD' adds 1 to the output 'Z2', which comes from the latch 'LAT1', to obtain its output 'X' as a decimal fraction and output the output 'X'. The output 'X' from the addition unit 'ADD' is output to the selector 'SEL'.

A comparator 'CMP' makes a comparison between the output 'Z1' from the subtraction unit 'SUB' and the horizontal reduction ratio 'Nh'. More concretely to say; when the horizontal reduction ratio 'Nh' is smaller than the output 'Z1' from the subtraction unit 'SUB' and the output 'Z1' from the subtraction unit 'SUB' is greater than 0, the comparator 'CMP' makes the horizontal write request "WRqh' have the level 'H'. In any other case, the horizontal write request "WRqh' is made to have the level 'L'.

The output from the comparator 'CMP' is also supplied to a latch 'LAT2'. Then, the output from the latch 'LAT2' becomes a switching control signal for the selector 'SEL'. When the output from the latch 'LAT2' is 1 (Level 'H'), the selector 'SEL' outputs the output 'X' from the addition unit 'ADD'. When the output from the latch 'LAT2' is 0 (Level 'L'), the selector 'SEL' outputs the output 'Z2' from the latch 'LAT1'.

Figure 16:
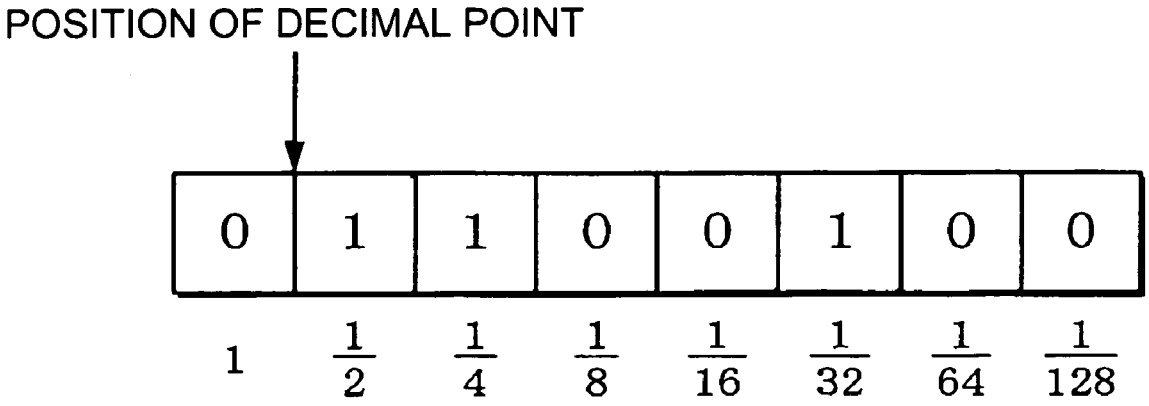
FIG. 16 shows a drawing to describe the horizontal reduction ratio shown in FIG. 15.

FIG. 16 shows a drawing to describe the horizontal reduction ratio 'Nh'.

When it is assumed that the horizontal pixel-skipping circuit 362 is provided with an accuracy of 8 bits, the horizontal reduction ratio 'Nh' can be expressed with the MSB as an integer value and the remainder as a decimal fraction value. For example, when the horizontal reduction ratio 'Nh' is 1, it can be expressed as "10000000".

In the following sections; while the horizontal reduction ratio 'Nh' being assumed to be 0.781, an example of operation of the horizontal pixel-skipping circuit 362 shown in FIG. 15 is explained. When the horizontal reduction ratio 'Nh' is 0.781, an approximation can be made as $0.781=\frac{1}{2}+\frac{1}{4}+\frac{1}{32}$ so that the ratio value can be expressed with an 8-bit value "01100100".

Figure 17:
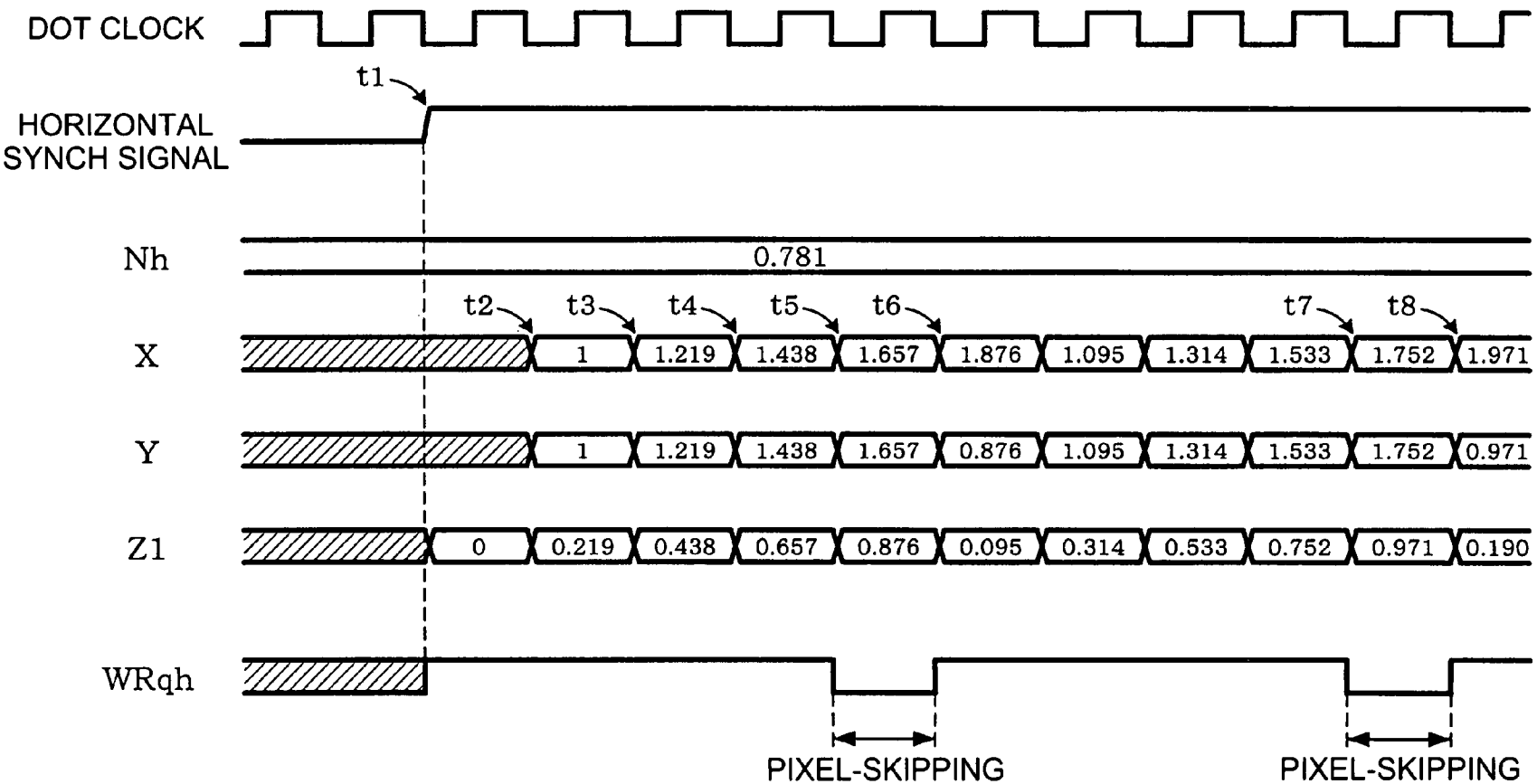
FIG. 17 shows a drawing to describe the timing in an operation example of the horizontal pixel-skipping circuit shown in FIG. 15.

FIG. 17 shows a drawing to describe the timing in an operation example of the horizontal pixel-skipping circuit 362 shown in FIG. 15.

When the horizontal synch signal changes from the level 'L' to the level 'H' at the time 't1', the output 'Z1' from the subtraction unit 'SUB' gets initialized to be 0. At this time, the horizontal reduction ratio 'Nh' (=0.781) is greater than the output 'Z1' (=0) from the subtraction unit 'SUB', and therefore the output "WRqh' from the comparator 'CMP' becomes 1 (Level 'H').

At the time of the next falling signal edge of the dot clock, 't2', the output from the latch 'LAT2' becomes 1 (Level 'H'). At this time, the latch 'LAT1' acquires the output 'Z1' from the subtraction unit 'SUB' and outputs it as the output 'Z2'. The output 'X' from the addition unit 'ADD' is 1. Since the output from the latch 'LAT2' is 1, the output 'Y' from the selector 'SEL' is provided with the output 'X' (=1) from the addition unit 'ADD'. As a result, the output 'Z1' from the subtraction unit 'SUB' becomes 0.219 (=1−0.781). At this time, the horizontal reduction ratio 'Nh' (=0.781) is greater than the output 'Z1', and therefore, the output "WRqh' from the comparator 'CMP' remains unchanged to be 1 (Level 'H').

Similarly; after the time of the next falling signal edge of the dot clock, 't3', passes off, the output 'X' from the addition unit 'ADD' becomes 1.219 so that the output 'Z1' from the subtraction unit 'SUB' becomes 0.438 (=1.219−0.781). Also on this occasion, the horizontal reduction ratio 'Nh' (=0.781) is greater than the output 'Z1', and therefore, the output "WRqh' from the comparator 'CMP' remains unchanged to be 1 (Level 'H').

Furthermore, after the time of the next falling signal edge of the dot clock, 't4', passes off, the output 'Z1' from the subtraction unit 'SUB' becomes 0.657 (=1.438−0.781). Also on this occasion, the horizontal reduction ratio 'Nh' (=0.781) is greater than the output 'Z1', and therefore, the output "WRqh' from the comparator 'CMP' remains unchanged to be 1 (Level 'H').

Then, after the time of the next falling signal edge of the dot clock, 't5', passes off, the output 'Z1' from the subtraction unit 'SUB' becomes 0.876 (=1.657−0.781). On this occasion, the horizontal reduction ratio 'Nh' (=0.781) becomes smaller than the output 'Z1', and therefore, the output "WRqh' from the comparator 'CMP' changes to be 0 (Level 'L').

Then, after the time of the next falling signal edge of the dot clock, 't6', passes off, the output from the latch 'LAT2' becomes 0 (Level 'L'). At this time, the latch 'LAT1' acquires the output 'Z1' from the subtraction unit 'SUB' and outputs it as the output 'Z2'. The output 'X' from the addition unit 'ADD' is 1.876. Since the output from the latch 'LAT2' is 0, the output 'Y' from the selector 'SEL' is provided with the output 'Z2' (=0.876) from the latch 'LAT1'. As a result, the output 'Z1' from the subtraction unit 'SUB' becomes 0.095 (=0.876−0.781). At this time, the horizontal reduction ratio 'Nh' (=0.781) is greater than the output 'Z1', and therefore, the output "WRqh' from the comparator 'CMP' changes to be 1 (Level 'H') again.

Similarly, the output "WRqh' from the comparator 'CMP' changes to be 0 (Level 'L') at the time 't7', and it changes to be 1 (Level 'H') at the time 't8'.

Thus, it is possible to make the output "WRqh' from the comparator 'CMP' have the level 'H' only for the period according to the horizontal reduction ratio 'Nh' (=0.781)

The above explanation up to here is made regarding the structure and operation of the horizontal pixel-skipping circuit 362 shown in FIG. 13, and the same can be said for the vertical pixel-skipping circuit 364 shown in FIG. 13. Different points are only the facts that; each section of the vertical pixel-skipping circuit 364 operates with reference to the horizontal synch signal, the subtraction unit gets initialized at the timing of a rising signal edge of the vertical synch signal, and a vertical reduction ratio 'Nv' is input instead. Consequently, since the vertical pixel-skipping circuit 364 can also be materialized in the same way, explanation on the vertical pixel-skipping circuit is omitted.

Furthermore, the structure and operation of the second image size reducing circuit 270 shown in FIG. 5 are the same as those of the first image size reducing circuit 260 described above. Replacing the operation of writing into the frame memory 280 with that of writing into the display memory 290 enables the second image size reducing circuit 270 to implement the same, and therefore, explanation on the structure and operation of the second image size reducing circuit 270 is omitted. Also in the case of the second image size reducing circuit 270; the write starting address and the second reduction ratio specified with the horizontal reduction ratio and the vertical reduction ratio are input into the second image size reducing circuit 270. These pieces of information are set by the host. The host sets these pieces of information as the control information for the second image size reducing circuit into the second image size reduction control register 358 of the control register 320.

Next, the JPEG compression circuit 240 shown in FIG. 5 is described.

Figure 18:
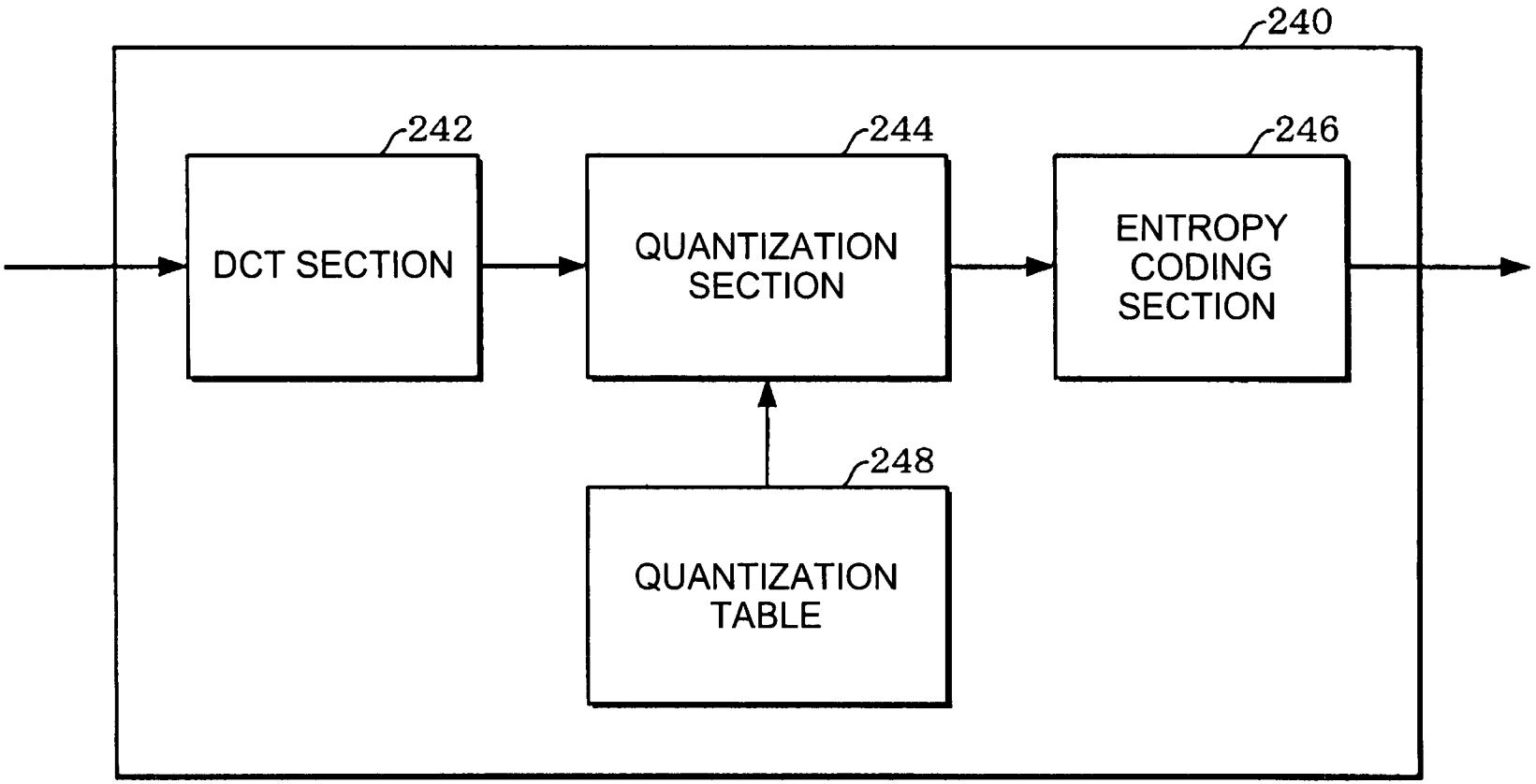
FIG. 18 shows a block diagram to illustrate an example of a structure of the JPEG compression circuit shown in FIG. 5.

FIG. 18 shows a block diagram to illustrate an example of a structure of the JPEG compression circuit 240 shown in FIG. 5.

The JPEG compression circuit 240 implements the function of image data compressing section 70 shown in FIG. 1. The JPEG compression circuit 240 includes; a discrete cosine transform (DCT) section 242, a quantization section 244, an entropy coding section 246, and a quantization table 248.

The DCT section 242 carries out a DCT operation for each block that includes, for example, 8 pixels by 8 pixels per one block. The operation extracts a DC element and an AC element from the objective data, and the AC element is expressed with fractions of each individual frequency specified.

The quantization section 244 carries out a quantization operation for the output data from the DCT section 242 by using a coefficient of the quantization table 248, in order to remove data of low frequency components.

The entropy coding section 246 carries out a coding operation by Huffman coding for the data quantized by the quantization section 244. Then, the output from the entropy coding section 246 eventually becomes image data after the compression operation.

The following sections describe an operation sequence of the display controller 200 provided with the structure explained above up to here, and the host, which is not illustrated, for controlling the display controller 200.

The host is equipped with a CPU (Central Processing Unit) and a memory, and a program for implementation of the flow described below is stored in the memory. Then, the CPU reads the program out of the memory to carry out the operation describe below.

Figure 19:
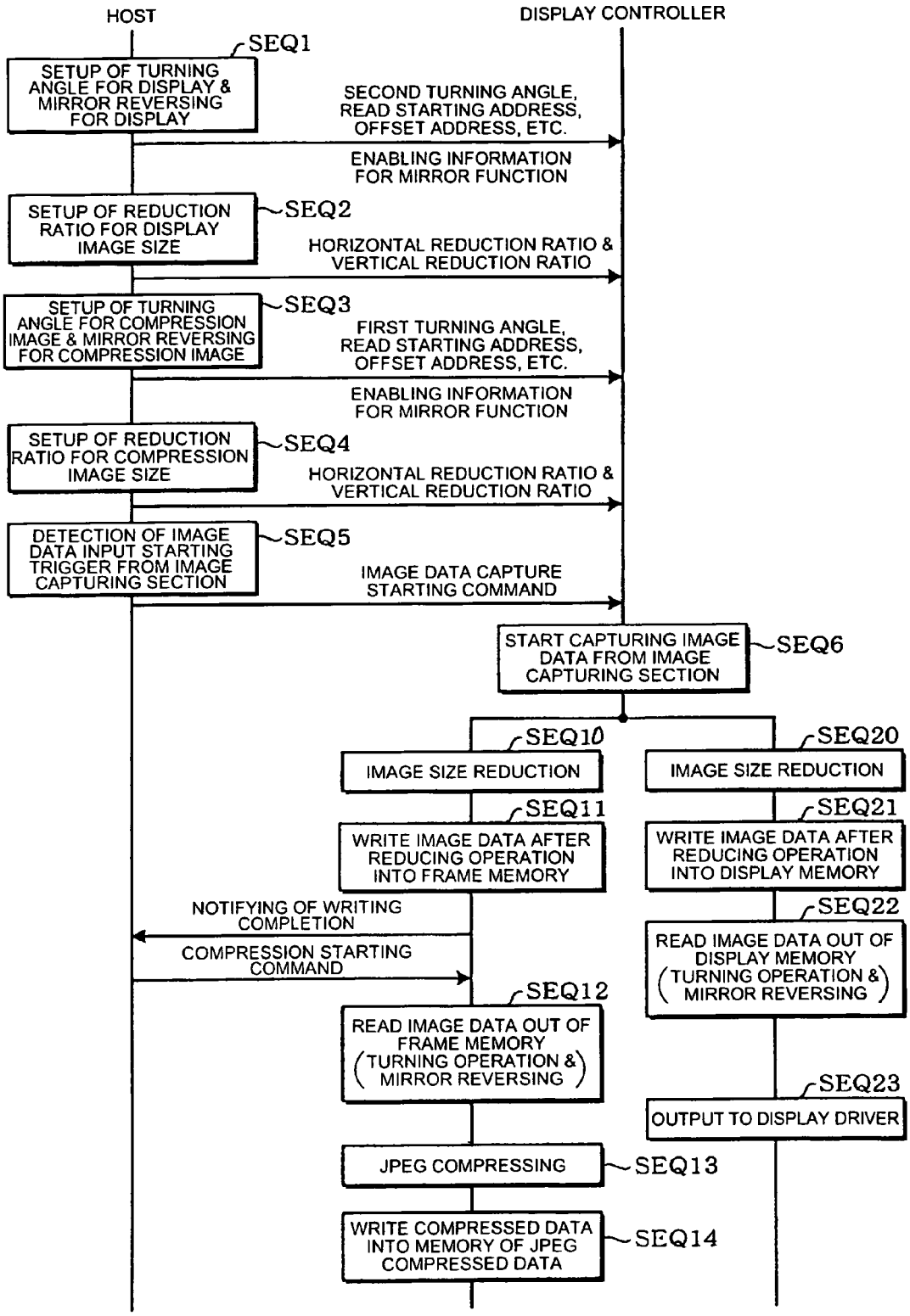
FIG. 19 shows an example of an operation sequence of the display controller shown in FIG. 5 and the host.

FIG. 19 shows an example of an operation sequence of the display controller 200 and the host.

At first, the host sets up a turning angle for an image to be displayed on the display panel and whether or not to carry out a mirror image reversing operation, in the control register 320 of the display controller 200 (SEQ1). In other words, the host sets up the second turning angle, enabling information for the mirror function, the read starting address and the offset address of the display memory 290 according to the second turning angle and the enabling information for the mirror function, the number of horizontal pixels, and the number of vertical pixels, in the display address control register 354 of the control register 320. Incidentally, if there are pre-defined combination patterns of the second turning angle and the enabling information for the mirror function, it is also possible that the display controller 200 calculates the offset address according to the combination of the second turning angle and the enabling information for the mirror function set by the host.

Subsequently, the host sets up a reduction ratio for an image to be displayed on the display panel in the control register 320 of the display controller 200 (SEQ2). In other words, the host sets up the second reduction ratio specified with the horizontal reduction ratio and the vertical reduction ratio, in the second image size reduction control register 358 of the control register 320.

Then, the host sets up a turning angle for an image to be compressed and whether or not to carry out a mirror image reversing operation, in the control register 320 of the display controller 200 (SEQ3). In other words, the host sets up the first turning angle, enabling information for the mirror function, the read starting address and the offset address of the frame memory 280 according to the first turning angle and the enabling information for the mirror function, the number of horizontal pixels, and the number of vertical pixels, in the image read address control register 352 of the control register 320. Incidentally, if there are pre-defined combination patterns of the first turning angle and the enabling information for the mirror function, it is also possible that the display controller 200 calculates the offset address according to the combination of the first turning angle and the enabling information for the mirror function set by the host.

Subsequently, the host sets up a reduction ratio for an image to be compressed in the control register 320 of the display controller 200 (SEQ4). In other words, the host sets up the first reduction ratio specified with the horizontal reduction ratio and the vertical reduction ratio, in the first image size reduction control register 356 of the control register 320.

Then, the host observes if there comes up any image data input starting trigger from the image capturing section (Camera module): (SEQ5). As the input starting trigger, a detection signal of the button of the cellular phone as an electronic device, in which the host and the display controller 200 are built, can be used at the time when the button is pressed for commanding the capturing section to start capturing an image. When detecting such an input starting trigger, the host outputs an image data capture starting command to the display controller 200.

Furthermore, the display controller 200 can have a capture starting control register, which is not illustrated in the drawing, in the control register 320. By the host's accesses to the capture starting control register according to the image data capture starting command; the display controller 200, in which various pieces of control information are set up in the control register 320 through SEQ 1 to SEQ4, can start capturing image data through the camera I/F circuit 210 (SEQ6).

Then after SEQ6, the display controller 200 independently carries out compressing operations, turning operation, and so forth on the image data through 2 flow lines.

To describe in other words; in the display controller 200, the image data stored in the FIFO 300 through the camera I/F circuit 210 are read out in due order, and the first image size reducing circuit 260 reduces the image size with the first reduction ratio (SEQ10). Then, according to a result of mediation by the frame memory access mediation circuit 324, the image data after the reducing operation are written into a memory area in the frame memory 280 specified with an address from the first camera data address generation circuit 304 (SEQ11).

The display controller 200 is notified of an interrupt acknowledgment of writing completion by the host when a writing operation of image data for one frame, for example, into the frame memory 280 is completed. Having received the interrupt acknowledgment of writing completion, the host is able to issue a compression starting command at an appointed timing. When the compression starting command from the host is received, the JPEG compression circuit 240 in the display controller 200 reads the image data out of a memory area in the frame memory 280 specified with the address from the image read address generation circuit 220 (SEQ12). As already described above, a turning operation to turn the orientation of the image and a mirror image reversing operation can be implemented by changing the order of reading the image data.

Subsequently, the JPEG compression circuit 240 carries out a compressing operation according to the standards of JPEG (SEQ13), and then writes the image data after the compressing operation into a memory area in the memory of JPEG compressed data 250 (SEQ14), which is appointed with an address from the compression data address generation circuit 310, according to a result of mediation by the JPEG compression data memory access mediation circuit 326. Then the image data stored in the memory of JPEG compressed data 250 are transferred to an external storage memory through the host I/F circuit 214, and/or used as a part of transmission data.

Meanwhile; in the display controller 200, the image data stored in the FIFO 300 through the camera I/F circuit 210 are read out in due order, and the second image size reducing circuit 270 reduces the image size with the second reduction ratio (SEQ20). Then, according to a result of mediation by the display memory access mediation circuit 322, the image data after the reducing operation are written into a memory area (SEQ21) in the display memory 290 specified with an address from the second camera data address generation circuit 306.

Subsequently, in the display controller 200, the image data stored in the display memory 290 are read out of a memory area specified with the read address from the LCD display address generation circuit 230 (SEQ22). As already described above, a turning operation to turn the orientation of the image and a mirror image reversing operation can be implemented by changing the order of reading the image data.

Then, the image data read out of the display memory 290 in such a manner are stored in the FIFO 302 in due order, and then output to a display driver through the LCD I/F circuit 212 for driving a display panel (SEQ23).

By the way; in the display controller that has been described up to here, the image data input through the camera interface circuit are once stored in the memory after reducing the image size, and then a processing operation is carried out. However, the way of actual operation is not restricted to carrying out operation only in such a manner.

Figure 20:
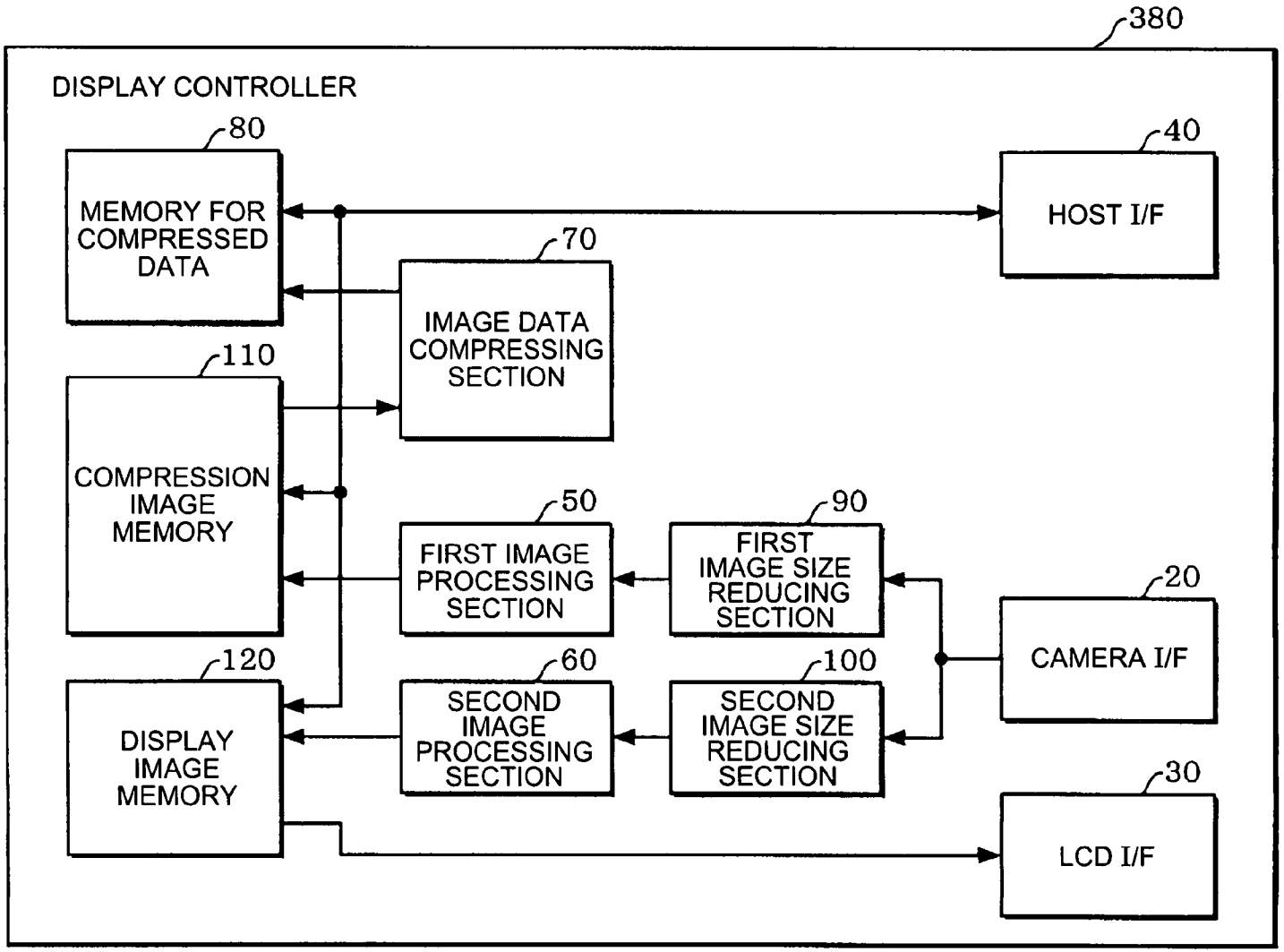
FIG. 20 shows a block diagram to illustrate a general structure of a display controller of a modification for the present embodiment.

FIG. 20 shows a block diagram to illustrate a general structure of a display controller of a modification for the present embodiment. Any section, which is the same as that of FIG. 1, is provided with the same reference numeral as given in FIG. 1, and explanation on the section is suitably omitted.

A different point in a display controller 380 of this modification, in comparison with the display controller 10 shown in FIG. 1, is the fact that image data input through the camera I/F circuit 20 are reduced in image size and treated through a processing operation at first, and then stored in a memory.

That is to say; the image data input into the camera I/F circuit 20 are supplied to the first image size reducing section 90 and the second image size reducing section 100. Output from the first image size reducing section 90 is supplied to the first image processing section 50. Meanwhile, output from the second image size reducing section 100 is supplied to the second image processing section 60. Then, output from the first image processing section 50 is supplied to the compression image memory 110, while output from the second image processing section 60 is supplied to the display image memory 120.

Since operation of the display controller 380 of this modification is the same as that of the display controller 10 of the present embodiment, explanation on the operation is omitted. Even with the structure of this modification, the same result can be obtained as done with the present embodiment.

Figure 21:
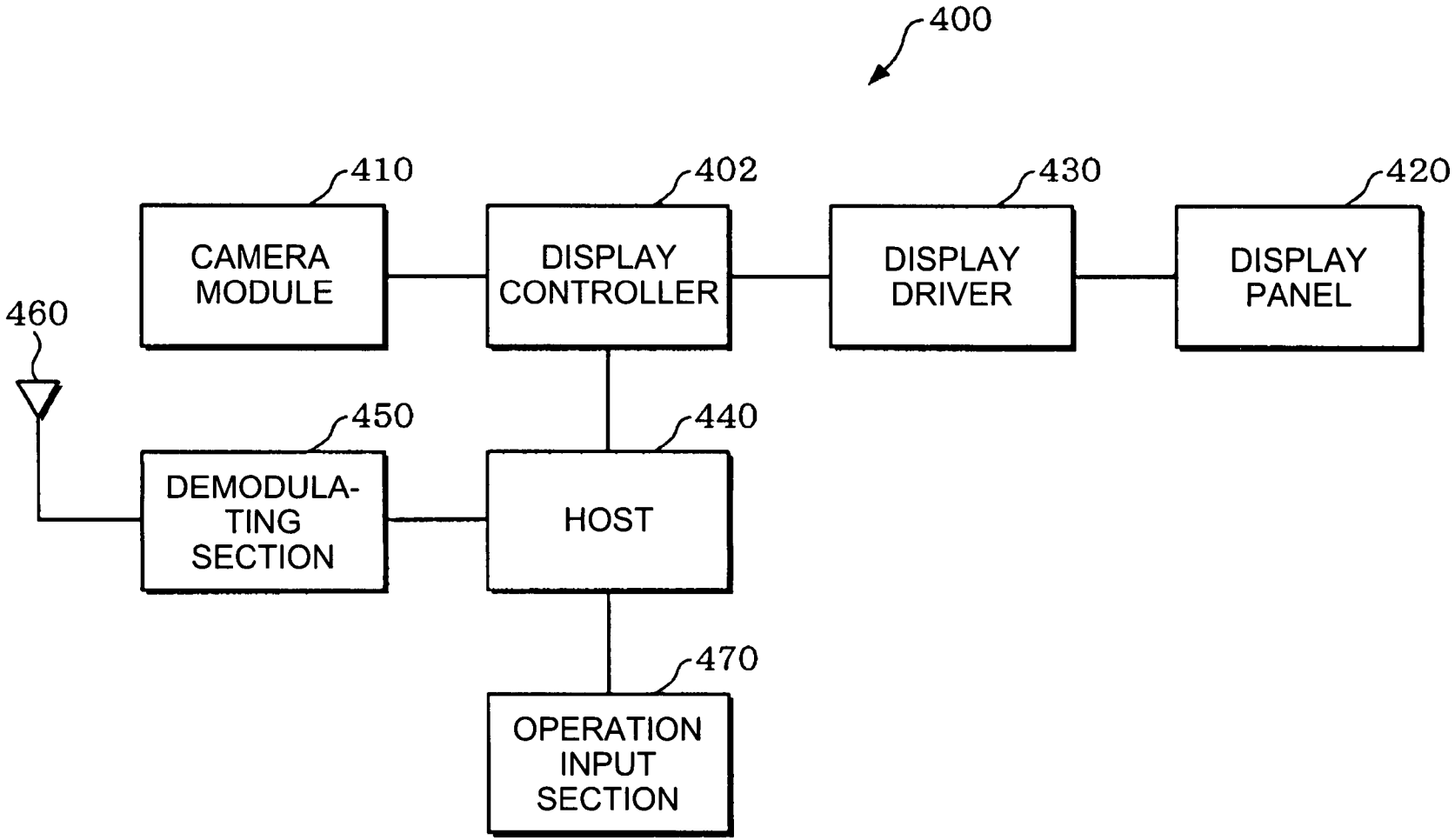
FIG. 21 shows a block diagram to illustrate an example of a structure of an electronic device in which a display controller of the present embodiment or its modification is applied.

FIG. 21 shows a block diagram to illustrate an example of a structure of an electronic device in which the display controller of the present embodiment or its modification is applied. In this case, a block diagram illustrating an example of a structure of a cellular phone as the electronic device is indicated.

A cellular phone 400 includes a camera module 410. Then, being equipped with a CCD camera, the camera module 410 supplies data of an image captured by the CCD camera to a display controller 402.

The cellular phone 400 includes a display panel 420. As the display panel 420, an LCD panel can be adopted. In this case, the display panel 420 is driven by a display driver 430. The display panel 420 includes a plurality of scanning lines, a plurality of data lines, and a plurality of pixels. The display driver 430 is provided with a scanning driver function to select one scanning line or multiple scanning lines out of the plurality of scanning lines, and it is also provided with a data driver function to supply the plurality of data lines with voltage corresponding to image data.

The display controller 402 is connected to the display driver 430 in order to supply the display driver 430 with image data.

A host 440 is connected to the display controller 402. The host 440 controls the display controller 402. Furthermore, after demodulating image data received through an antenna 460 by a demodulating section 450, the host 440 can supply the display controller 402 with the demodulated image data. According to the image data, the display controller 402 displays the image on the display panel 420 with the display driver 430.

After demodulating image data, created by the camera module 410, in the demodulating section 450, the host 440 can issue a command to transmit the demodulated image data through the antenna 460 to another communication system.

The host 440 carries out a transmitting/receiving operation, a compressing operation, a turning operation, and a mirror image reversing operation, on image data; an image capturing by the camera module 410; and a display operation on the display panel; according to operation information from an operation input section 470.

In this cellular phone 400, the orientation of an image of image data captured by the camera module 410 is fixed. However, even if the orientation of the image displayed on the display panel 420 is different from that of the image of the image data included in the data to be transmitted through the antenna 460, it is still possible to transmit the transmission data including the image data of the image that is of the same frame as the image displayed on the display panel 420.

By the way, an LCD panel for example as the display panel 420 is described in relation to FIG. 21, but the display panel is not confined to such a device. The display panel 420 can be an electro luminescence display or plasma display device, and it can be applied for the display controller that supplies image data to the display driver for driving the display panel.

Incidentally, the present invention is not confined to the embodiment described above, and it is possible to implement various modifications within the scope of the substantial concept of the present invention. For example, each image processing section can not only work for the turning operation and mirror image reversing operation, but also implement other types of image processing. Furthermore, in each of FIG. 1, FIG. 5, FIG. 6, FIG. 13, FIG. 15, FIG. 18, FIG. 20, and FIG. 21; it is not necessary to include all the blocks and it is possible to have a structure in which a block or more are partially eliminated.

With regard to an invention relating to any dependent claim of the present invention, it is possible to eliminate a part of the structural elements of the claim to which the dependent claim is subordinate. Furthermore, it is also possible to subordinate a substantial part of an invention relating to any independent claim of the present invention to another independent claim.

What is claimed is:

1. A display controller that is connected to a host and supplies image data to a display driver for driving a display panel, comprising:

an image data input interface to which first image data are input;

a first image processing section that carries out a first processing operation that includes at least either of a turning image operation and a mirror image reversing operation, the first image processing section outputting second image data based on the first image data;

a second image processing section that carries out a second processing operation that includes at least either of a turning image operation and a mirror image reversing operation, the second image processing section outputting fourth image data based on the first image data;

an image data compressing section that compresses the second image data and outputs third image data;

a memory where the third image data is stored;

a host interface to/from which the third imaged data stored in the memory is input and output;

a display driver interface that outputs the fourth image data to the display driver, the first image processing section and the second image processing section carrying out the first processing operation and the second processing operation on the first image data of an identical frame input through the image data input interface;

a first image size reducing section and a second image size reducing section to create image data reduced in size with a first reduction ratio and a second reduction ratio, respectively, from the first image data input through the image data input interface, the first image processing section carrying out the first processing operation for the image data created by the first image size reducing section, the second image processing section carrying out the second processing operation for the image data created by the second image size reducing section, and the first image size reducing section and the second image size reducing section creating the image data reduced in size with the first reduction ratio and the second reduction ratio, respectively, for the image size of identical image data.

2. The display controller according to claim 1, comprising:

a compression image memory where the image data created by the first image size reducing section are stored, and a display image memory where the image data created by the second image size reducing section are stored, the first image processing section reading the image data out of the compression image memory read out of the compression image memory, and the second image processing section reading the image data out of the display image memory and carrying out the second processing operation for the image data read out of the display image memory.

3. The display controller according to claim 1, comprising:

a compression image memory where the second image data is stored, and a display image memory where the fourth image data is stored, the image data compressing section carrying out the compressing operation for the image data read out of the compression image memory, and the display driver interface supplying the display driver with the image data read out of the display image memory.

4. The display controller according to claim 1, comprising:

the first image size reducing section and the second image size reducing section creating image data such that the size of the image reduced by the first image size reducing section becomes greater than the size of the image reduced by the second image size reducing section.

5. The display controller according to claim 4, comprising:

the host interface receiving the third image data stored in the memory after the compressing operation; and the display driver interface receiving the fourth image data outputted from the second image processing section, the third image data stored in the memory after the compression operation is different in size than the fourth image data outputted from the second image processing section.

6. An electronic device, comprising:

a display panel;

a display controller described by claim 1; and a display driver for driving the display panel according to image data supplied by the display controller.

7. The electronic device according to claim 6, comprising:

a host that inputs and outputs image data to/from the display controller.

8. A method of supplying image data to supply the image data to a display driver for driving a display panel, comprising:

performing a first processing operation that includes at least either of a turning image operation to turn an orientation of an image with a first turning angle and a mirror image reversing operation, for first image data input from an image capturing section to output second image data;

performing a second processing operation that includes at least either of a turning image operation to turn an orientation of an image with a second turning angle and a mirror image reversing operation, for the first image data to output fourth image data;

performing a compressing operation for the second image data for which the first processing operation has been carried out to output third image data;

supplying the fourth image data to the display driver; and supplying the third image data to a host interface, the first processing operation for image data created by reducing image size of the first image data with a first reduction ratio, and the second processing operation for image data created by reducing image size of the first image data with a second reduction ratio.

9. The method of supplying image data according to claim 8, comprising:

a step of creating image data with size reduction such that the size of the image reduced with the first reduction ratio becomes greater than the size of the image reduced with the second reduction ratio.

* * * * *